US010571084B2

(12) United States Patent
Jang

(10) Patent No.: US 10,571,084 B2
(45) Date of Patent: Feb. 25, 2020

(54) LIGHTING MODULE, AND LIGHTING APPARATUS HAVING SAME

(71) Applicant: LG INNOTEK CO., LTD., Seoul (KR)

(72) Inventor: Chul Ho Jang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 16/064,303

(22) PCT Filed: Dec. 19, 2016

(86) PCT No.: PCT/KR2016/014883
§ 371 (c)(1),
(2) Date: Jun. 20, 2018

(87) PCT Pub. No.: WO2017/111413
PCT Pub. Date: Jun. 29, 2017

(65) Prior Publication Data

US 2019/0003660 A1 Jan. 3, 2019

(30) Foreign Application Priority Data

Dec. 21, 2015 (KR) ..... 10-2015-0183156

(51) Int. Cl.
*F21S 2/00* (2016.01)
*F21V 31/00* (2006.01)
(Continued)

(52) U.S. Cl.
CPC ..... *F21S 2/005* (2013.01); *F21K 9/60* (2016.08); *F21V 5/007* (2013.01); *F21V 5/04* (2013.01);
(Continued)

(58) Field of Classification Search
CPC ..... F21V 23/005; F21V 31/00; F21V 19/00; F21V 5/007; F21V 5/04; F21V 29/74;
(Continued)

(56) References Cited

U.S. PATENT DOCUMENTS 9,518,724 B2 12/2016 Kwak et al.
2011/0317425 A1* 12/2011 Jeon ..... F21S 2/005 362/249.05
(Continued)

FOREIGN PATENT DOCUMENTS

KR 10-0955037 4/2010
KR 10-2012-0062173 6/2012
(Continued)

OTHER PUBLICATIONS

English Machine Translation of KR20150060499 (Year: 2015).*
(Continued)

*Primary Examiner* — Zheng Song
(74) *Attorney, Agent, or Firm* — Ked & Associates LLP

(57) ABSTRACT

An embodiment discloses a lighting module. The lighting module disclosed in an embodiment comprises: a light emitting module having a printed circuit board and a plurality of light emitting devices; and a cover having a cover body disposed on the printed circuit board and a plurality of lens portions disposed on the light emitting devices. The plurality of lens portions include a concave recess, an incident surface around the recess and an output surface having a convex curved surface, wherein an interval in a first axial direction are arranged more narrowly than an interval in a second axial direction. Two or more of the light emitting devices disposed in the respective lens portion are arranged in the first axial direction. A bottom of the recess has a longer length in the first axial direction than in the second axial direction with reference to the bottom centre of the recess; and the incident surface of the lens portions has a longer length in the first axial direction than in the second axial direction, has a convex curved surface in the first axial direction, and includes a concave part in which a curved
(Continued)

surface in the second axial direction is depressed towards the recess.

20 Claims, 19 Drawing Sheets

(51) Int. Cl.

| | |
|---|---|
| ***F21V 29/80*** | (2015.01) |
| ***F21V 23/00*** | (2015.01) |
| ***F21V 5/00*** | (2018.01) |
| ***F21V 5/04*** | (2006.01) |
| ***F21V 19/00*** | (2006.01) |
| ***F21V 29/74*** | (2015.01) |
| ***F21K 9/60*** | (2016.01) |
| ***H05B 33/08*** | (2020.01) |
| *F21Y 105/10* | (2016.01) |
| *F21Y 115/10* | (2016.01) |
| *F21Y 113/17* | (2016.01) |
| *F21V 17/12* | (2006.01) |
| *F21V 27/02* | (2006.01) |

(52) U.S. Cl.
CPC ..... *F21V 19/00* (2013.01); *F21V 23/00* (2013.01); *F21V 23/005* (2013.01); *F21V 29/74* (2015.01); *F21V 29/80* (2015.01); *F21V 31/00* (2013.01); *H05B 33/0803* (2013.01); *F21V 17/12* (2013.01); *F21V 23/001* (2013.01); *F21V 27/02* (2013.01); *F21Y 2105/10* (2016.08); *F21Y 2113/17* (2016.08); *F21Y 2115/10* (2016.08)

(58) Field of Classification Search
CPC ... H05B 33/0803; F21K 9/60; F21Y 2105/10; F21Y 2113/17
See application file for complete search history.

(56) References Cited

U.S. PATENT DOCUMENTS

| | | | | |
|---|---|---|---|---|
| 2012/0188766 | A1* | 7/2012 | Lu | F21V 29/2212 362/249.02 |
| 2013/0100662 | A1* | 4/2013 | Lin | F21K 9/00 362/235 |
| 2013/0176733 | A1* | 7/2013 | Lu | F21V 29/2212 362/249.02 |
| 2015/0146431 | A1* | 5/2015 | Kwak | F21V 17/104 362/294 |
| 2017/0089566 | A1* | 3/2017 | Wu | F21V 33/0076 |

FOREIGN PATENT DOCUMENTS

| | | | | |
|---|---|---|---|---|
| KR | 20-2012-0006141 U1 | | 9/2012 | |
| KR | 10-1284261 | | 7/2013 | |
| KR | 10-1446891 | | 10/2014 | |
| KR | 10-2014-0141965 | | 12/2014 | |
| KR | 10-2015-0060499 | | 6/2015 | |
| KR | 20150060499 | * | 6/2015 | F21S 2/00 |
| KR | 10-2015-0117007 | | 10/2015 | |

OTHER PUBLICATIONS

International Search Report (with English Translation) and Written Opinion dated Apr. 12, 2017 issued in Application No. PCT/KR2016/014883.

* cited by examiner

LIGHTING MODULE, AND LIGHTING APPARATUS HAVING SAME

CROSS-REFERENCE TO RELATED PATENT APPLICATIONS

This application is a U.S. National Stage Application under 35 U.S.C. § 371 of PCT Application No. PCT/KR2016/014883, filed Dec. 19, 2016, which claims priority to Korean Patent Application No. 10-2015-0183156, filed Dec. 21, 2015, whose entire disclosures are hereby incorporated by reference.

TECHNICAL FIELD

Embodiments relate to a lighting module and a lighting apparatus having the same.

BACKGROUND ART

In general, if a lighting apparatus employing a light emitting device is turned on, high-temperature heat is emitted. A lamp chamber is heated by the heat, so that the lifespan of the lamp and various parts to support the lamp may be degraded. For example, regarding a street lamp, if the street lamp is overheated, the street lamp is turned off above at a predetermined temperature through a control operation to prevent the failure of the street lamp. However, the situation that the street lamp is turned off refers to that the street lamp does not perform the inherent function thereof, which becomes a problem in itself.

In particular, when the street lamp is manufactured by using a light emitting diode (LED) that is recently spotlighted as a high-efficiency light source, the improvement in a heat radiation structure is significantly required to efficiently radiate heat generated from the LED.

Further, even if a conventional street lamp employs the LED, a globe is installed on the street lamp to cover the entire portion of the street lamp in a circular shape similarly to that of a conventional mercury or sodium street lamp, so that the heat radiation may be difficult. In addition, the conventional street lamp is regimentally installed without taking into consideration optical characteristics necessary for the installation place thereof, for example a distribution characteristic, luminance, and the degree of uniformity of light. Further, pollution may be increased by light irradiated rearward from the street lamp. Accordingly, the development of a novel LED lighting apparatus capable of solving the above problems is increasingly required.

In addition, in the case of a device used in a state of being exposed like a streetlight, there is a possibility that an accident caused by a short circuit may occur if the waterproofing is not performed well. Therefore, there is a great need to develop a safe LED lighting device which does not cause leakage even when used under bad conditions.

DISCLOSURE

Technical Problem

Embodiments provide a lighting module capable of reducing optical interference between a plurality of lens portions.

Embodiments provide a lighting module in which each of plurality of lens portions disposed on a cover is different in length in two axial directions orthogonal to a center of the lens portion.

The embodiment provides a light emitting module in which at least two light emitting devices are arranged under the incident surface of each of the plurality of lens portions of the cover.

An embodiment provides a light emitting module having a plurality of light emitting devices driven by an AC power source between a cover and a heat radiating plate.

Embodiments provide a lighting module in which a heat radiation pad is disposed between a heat radiation plate and a printed circuit board to improve heat radiation efficiency.

Embodiments provide a lighting module in which a waterproof frame is disposed around a light emitting module to prevent moisture from penetrating into the light emitting module.

Embodiments provide a waterproof module with a waterproof protrusion to press the heat dissipation and the cover to prevent water from penetrating into the printed circuit board.

The embodiment provides a lighting module having a heat dissipation flow path on the outside of the heat dissipation plate and a lighting apparatus having the same.

The embodiment provides a lighting apparatus in which a plurality of the above lighting modules are arranged.

Technical Solution

A lighting module according to an embodiment comprises: a light emitting module including a printed circuit board and a plurality of light emitting devices on the printed circuit board; and a cover including a cover body disposed on the printed circuit board and a plurality of lens portions disposed on the light emitting device, wherein the plurality of lens portions are disposed such that an interval in the first axis direction is narrower than an interval in the second axis direction, and each of the plurality of lens portions includes a concave recess, an incident surface around the recess and an output surface including a curved surface whose surface is convex, wherein at least two light emitting devices arranged in each of the lens portions are disposed in the first axis direction, wherein a bottom of the recess is longer than a length in the second axial direction with respect to a center of the bottom of the recess, wherein the output surface of the lens portion has a length in a first axial direction is longer than the length in the second axial direction, the output surface may include a convex curved surface in the first axial direction, and may include a concave portion concave in the recess direction at a curved surface in the second axial direction.

A lighting module according to an embodiment comprises: a heat dissipation plate including a plurality of heat dissipation fins; a light emitting module including a printed circuit board on the heat dissipation plate and a plurality of light emitting devices on the printed circuit board; and a cover including a cover body disposed on the printed circuit board and a lens portion disposed on the light emitting device, wherein the printed circuit board has a length in a first axis direction longer than a length in a second axis direction, wherein at least two of the light emitting devices are disposed at each of the lens portions, wherein the lens portions is disposed in M rows in the first axial direction and N columns in the second axial direction, wherein the M is 2 or more, the N is 2 or more and, the M is greater than the N, wherein the plurality of lens portions are arranged so that an interval in the first axial direction is narrower than an interval in the second axial direction, wherein each of the plurality of lens portions has a concave recess, an incident surface around the recess and an output surface has a curved surface whose a surface is convex, wherein at least two of the light emitting devices arranged in each of the lens portions are arranged in a first axis direction, and wherein a bottom of the recess is longer than a length in the second axial direction with respect to a center of the bottom of the recess and an output surface of the lens portion has a length in a first axial direction is longer than the length in the second axial direction, wherein the output surface of the lens portion has a longer length in the first axial direction than a length in the second axial direction, and wherein the output surface includes a curved surface convex in the first axial direction and includes a concave portion concave in the recess direction at least one of both sides in the second axial direction.

According to the embodiment, two to fourteen light emitting devices may be disposed in each of the lens portions.

According to an embodiment of the present invention, a number of outer rows of the light emitting device in each of the lens portions may be greater than the number of inner rows in the first axis direction passing through the bottom center of the recess.

According to the embodiment, a distance between the lens portions disposed in the first axial direction may be smaller than a height of the lens portion.

According to the embodiment, a distance between the lens portions disposed in the first axial direction may be smaller than the length in the first axial direction of the lens portion.

According to the embodiment, an intervals in the first axis direction may be equal to each other and an intervals in the second axis direction may be different from each other.

According to the embodiment, the light incident at the first angle through an edge region of the incident surface of the lens portion is emitted to an edge region of the output surface at the second angle, wherein the first angle is an angle incident with reference to a horizontal axis on a bottom surface of the cover body, wherein the second angle is an angle emitted with respect to a horizontal axis on an upper surface of the cover body, and the second angle may be greater than the first angle.

According to an embodiment, the lens portions adjacent to each other in the first axial direction may be spaced apart from each other with an angle smaller than the second angle with respect to a horizontal axis.

According to the embodiment, the printed circuit board may have a circuit portion for AC driving the light emitting device.

According to an embodiment, wherein the heat dissipation plate including a heat dissipation fin at a lower portion and a recess region at an upper portion; and a waterproof frame disposed outside the printed circuit board on the heat dissipation plate, wherein the printed circuit board is disposed in the recess region of the heat dissipation plate, and the waterproof frame is disposed between the heat dissipation and the cover.

According to an embodiment of the present invention, the waterproof frame may include a first waterproof protrusion protruded in the cover direction and a second water protrusion protruded in the direction of the heat dissipation plate. The heat dissipation plate may include a first guide rib disposed between the waterproof frame and the printed circuit board, and a second guide rib disposed outside the waterproof frame and the cover.

According to an embodiment of the present invention, a heat radiating pad may be disposed between the printed circuit board and the radiating plate. The heat radiating plate and the printed circuit board may have a length in a first axial direction longer than a length in a second axial direction.

According to the embodiment, the thickness of the cover body may be smaller than the height of the recess and larger than the thickness of the light emitting device.

According to the embodiment, the output surface s of the respective lens portions may have a symmetrical shape with reference to the second axial direction passing through the bottom center of the recess.

According to the embodiment, the concave portion may be disposed on at least one side of both sides of the output surface in the second axial direction.

According to the embodiment, the concave portions are disposed adjacent to the cover body and on both sides in the second axial direction of the output surface, and a depths of the concave portions disposed on both sides of the output surface may be different from each other.

Advantageous Effects

The embodiment can reduce the optical interference between the lens portions on the light emitting module.

The embodiment provides a light emitting device driven by an AC power source, so that a separate converter is not required.

The heat dissipation efficiency can be improved by disposing the heat dissipation plate and the heat dissipation pad under the light emitting module.

Embodiments can improve the heat radiation efficiency by bringing the entire region of the printed circuit board in close contact with the heat radiation pad.

The embodiment can suppress a penetration of a liquid by the heat radiating frame having the elastic force between the cover and the heat radiating plate in the outer region of the light emitting module.

The embodiment can improve the heat radiation efficiency by providing a heat dissipation path to the outside of the lighting module.

The embodiments may arrange the rows of the light emitting devices of the plurality of lighting modules at equal intervals so as not to affect the light distribution.

Embodiments can improve the reliability of the lighting module and the illumination device.

BEST MODE

Hereinafter, preferred embodiments of a light emitting module, a lighting module or a lighting apparatus having the same according to the embodiments will be described with reference to the accompanying drawings. The terms described under are defined in consideration of the functions in this embodiment, which may vary depending on the intention or custom of the user, the operator. Therefore, the definitions of these terms should be based on the contents throughout this specification. In addition, the following embodiments are not intended to limit the scope of the present invention, but merely as examples, and various embodiments may be implemented through the present invention.

Hereinafter, preferred embodiments of the present invention will be described in detail with reference to the accompanying drawings. The term of lighting module or lighting apparatus used in the present specification is used to refer to a lamp used for outdoor use, and collectively refers to a device similar to a street lamp, various lamps, an electric signboard, or a headlight.

Figure 1:
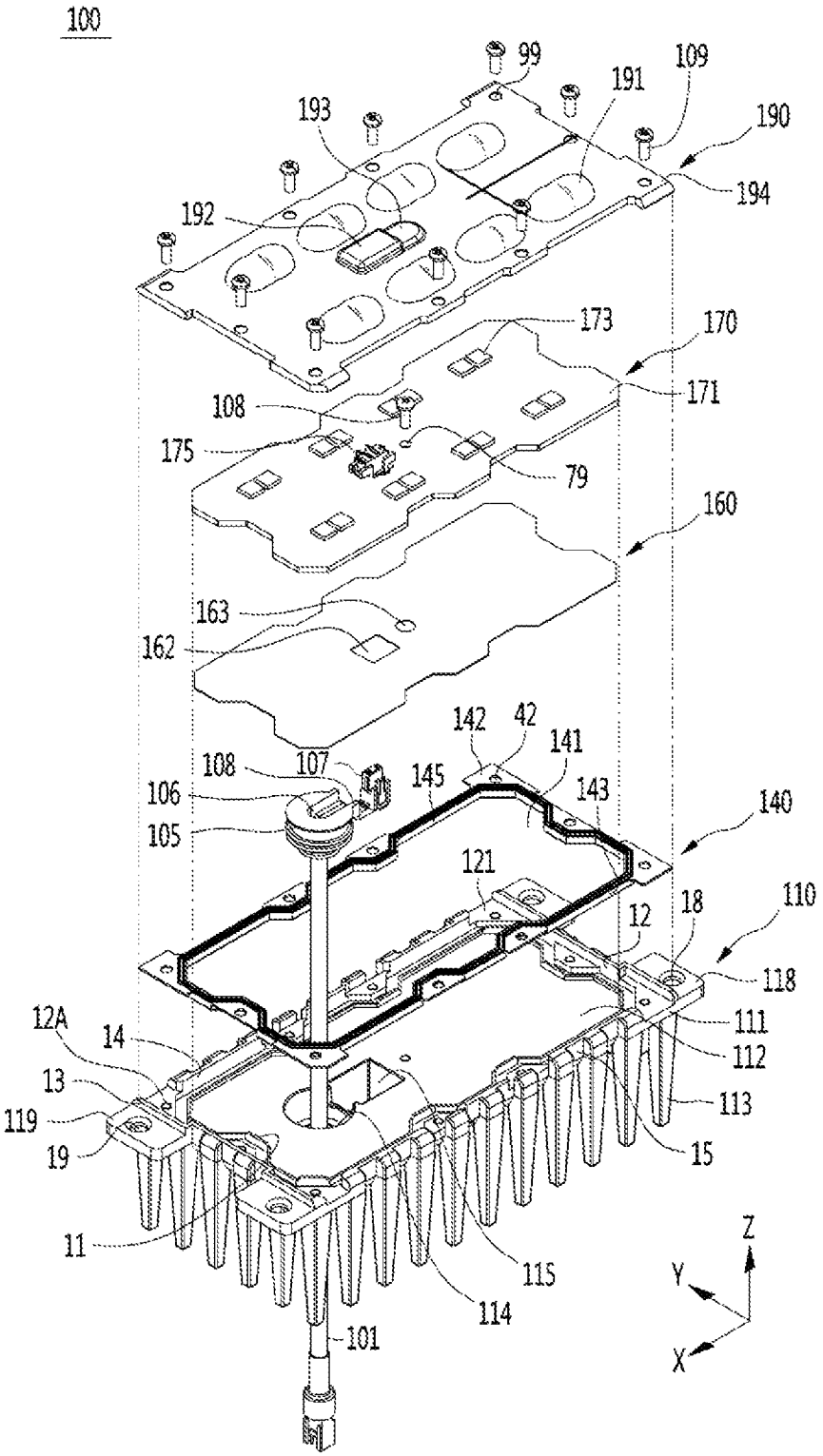
FIG. 1 is an exploded perspective view of a lighting module according to an embodiment.
Figure 2:
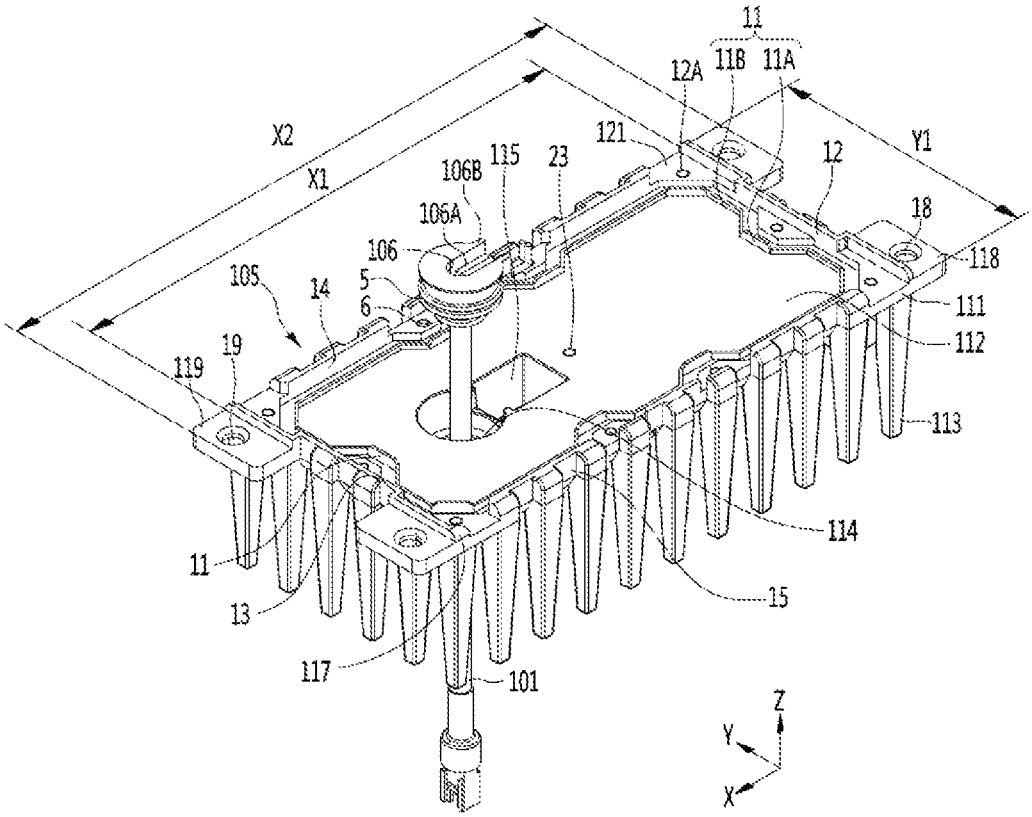
FIG. 2 is a perspective view illustrating a heat dissipation of the lighting module of FIG. 1.
Figure 3:
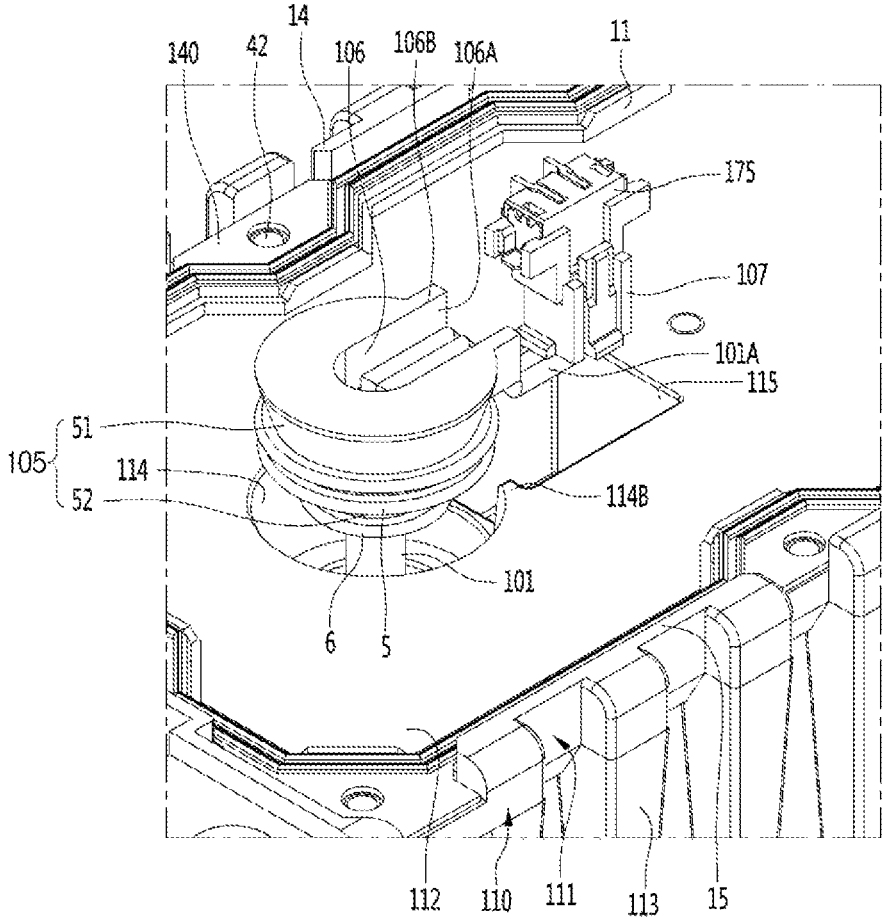
FIG. 3 is an exploded perspective view of a heat dissipation and a waterproof cap of the lighting module of FIG. 1.
Figure 5:
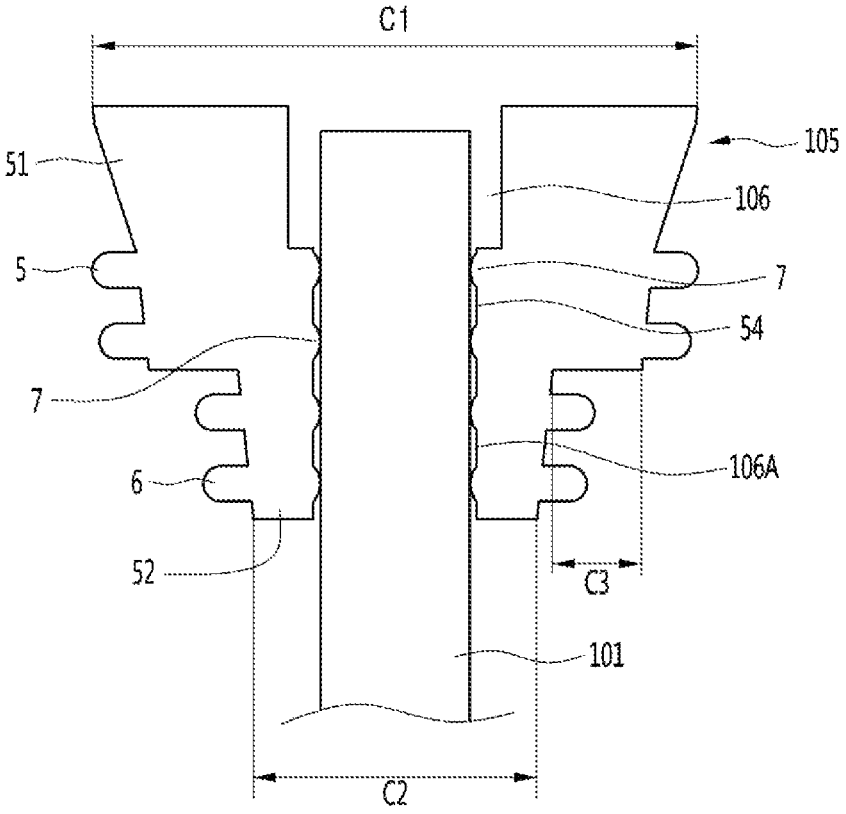
FIG. 5 is a side sectional view showing the heat radiation cap of FIG. 3.
Figure 6A:
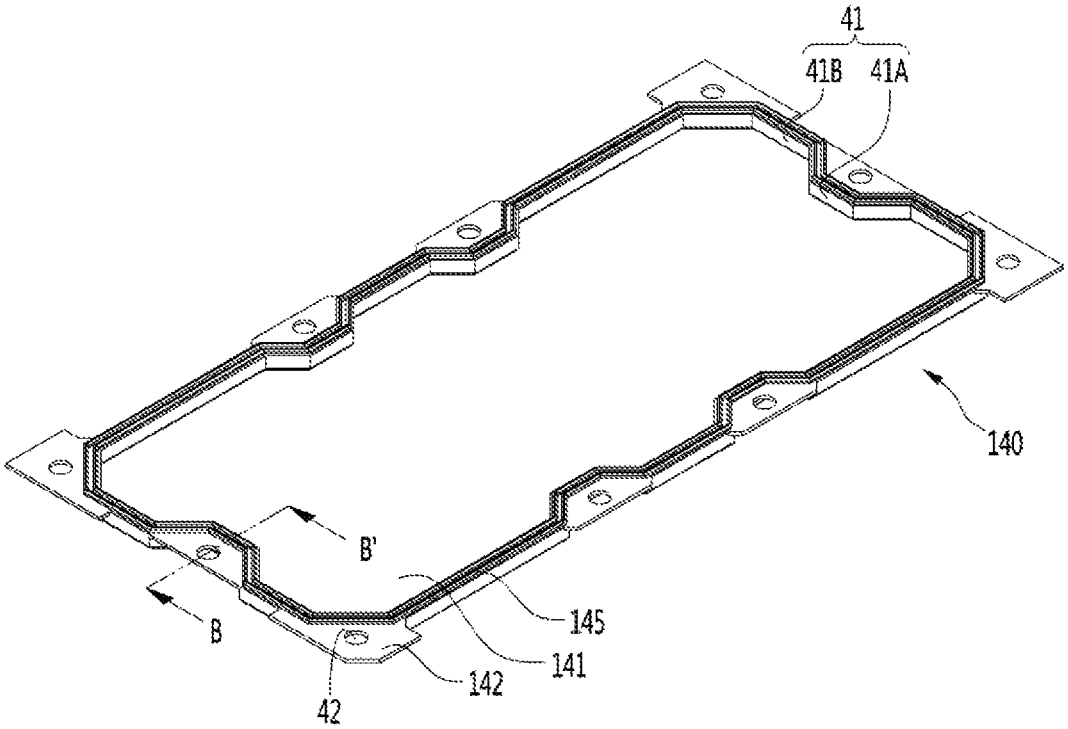
FIG. 6A is a perspective view showing a waterproof frame of the lighting module of FIG. 1.
Figure 6B:
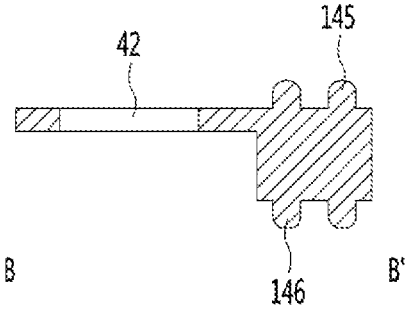
FIG. 6B is a sectional view of taken along the line B-B' in the waterproof frame of FIG. 6A.
Figure 7:
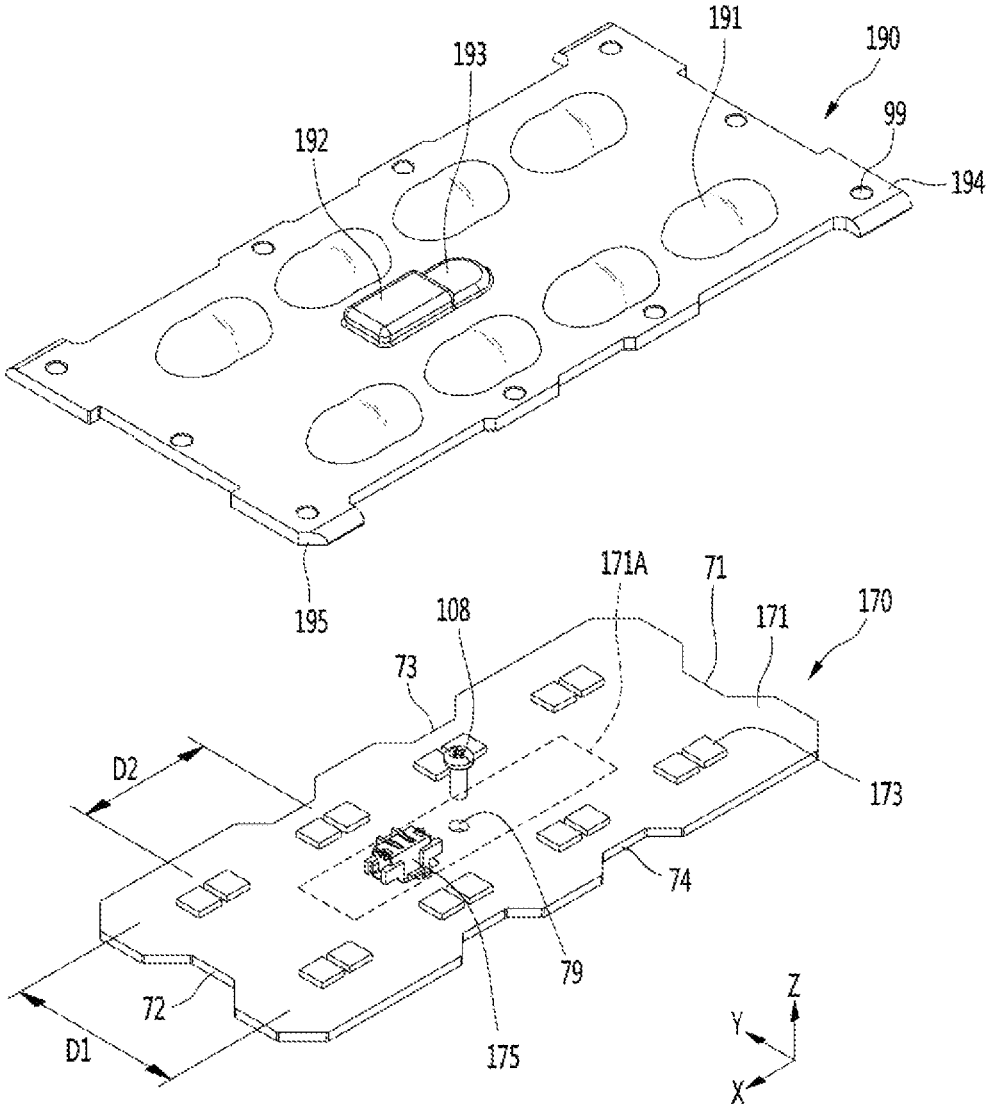
FIG. 7 is a view showing a light emitting module and a cover of the lighting module of FIG. 1.
Figure 8:
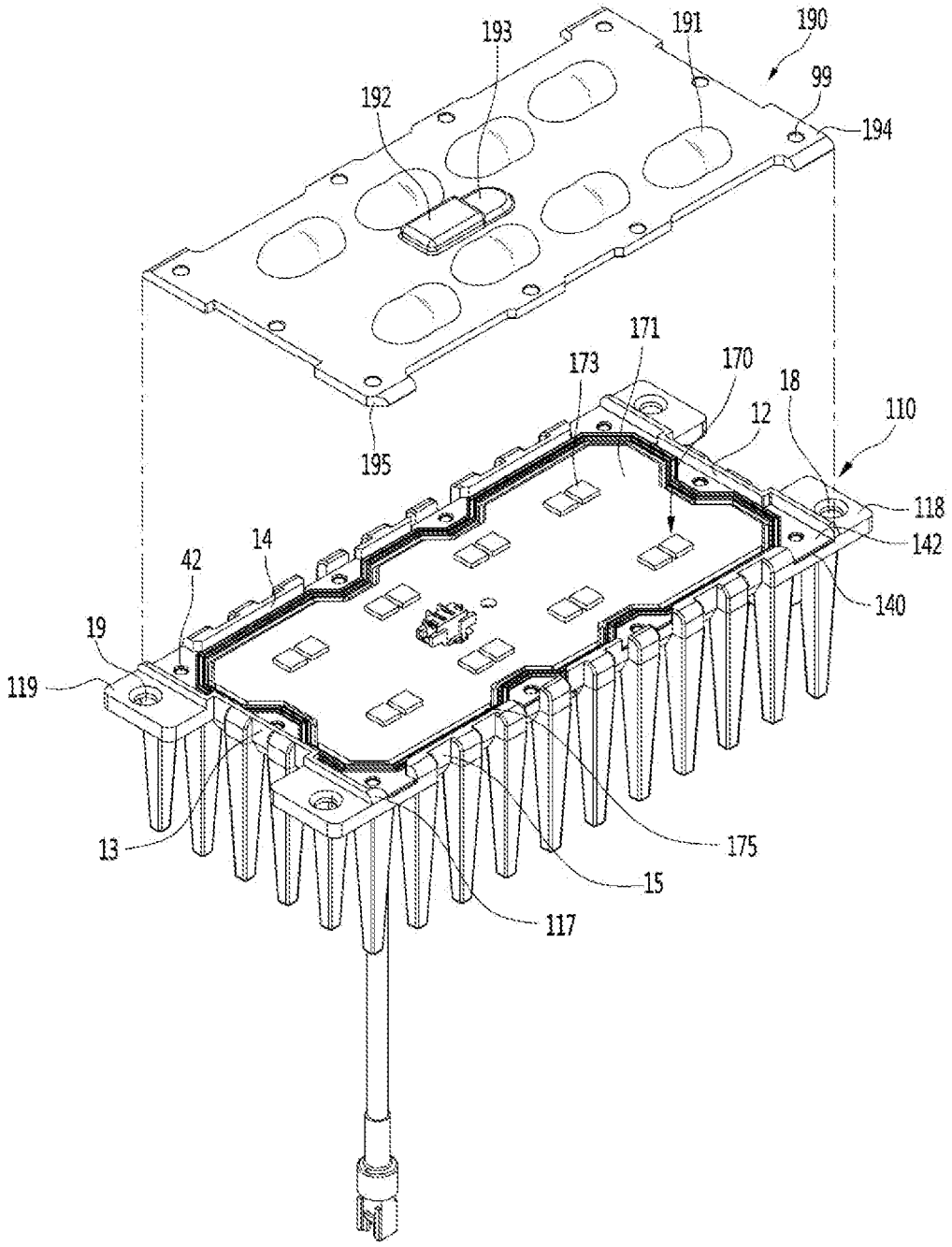
FIG. 8 is an exploded perspective view of a heat dissipation and a cover to which the light emitting module of the lighting module of FIG. 1 is coupled.
Figure 9:
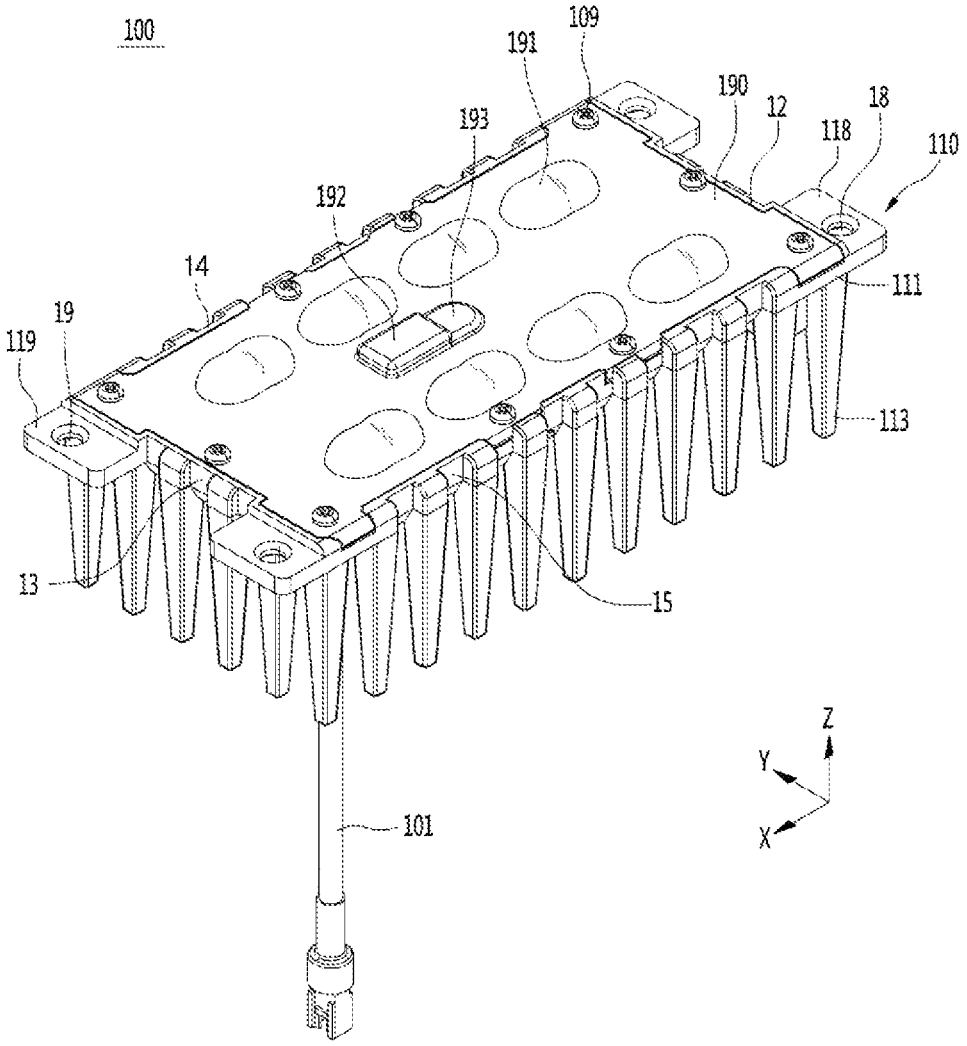
FIG. 9 is an assembled perspective view of the lighting module of FIG. 1.

FIG. 1 is an exploded perspective view showing a lighting apparatus according to an embodiment, FIG. 2 is a perspective view showing a heat dissipation of the lighting module of FIG. 1, FIG. 3 is an exploded perspective view of a heat dissipation and a waterproof cap of the lighting module of FIG. 1, FIG. 5 is a cross-sectional side view showing the heat radiation cap of FIG. 3, FIGS. 6A and 6B are views showing a waterproof frame of the lighting module of FIG. 1, and FIG. 7 is a view showing a light emitting module and a cover of the lighting module of FIG. 1, and FIG. 8 is an exploded perspective view of a heat dissipation and a cover to which the light emitting module of the lighting module of FIG. 1 is coupled.

As shown in FIGS. 1 to 8, the lighting module 100 includes a heat dissipation plate 110, a light emitting module 170 disposed on a first region of the heat dissipation plate 110 and including a printed circuit board 171 and a light emitting device 173, a waterproof frame 140 on the outer periphery of the first region of the heat dissipation plate 110 and a cover 190 disposed on the light emitting module 170.

The lighting module 100 may include a heat radiating pad 160 disposed between the heat radiating plate 110 and the printed circuit board 171. The lighting module 100 may include a waterproof cap 105 having a cable hole and coupled to a portion of the heat dissipation plate 110.

The heat dissipation plate 110 may include a metal material, and the metal material may include a metal or an alloy having excellent heat dissipation characteristics. The heat dissipation plate 110 may be formed of any one of Ag, Al, Au, Cr, Co, Cu, Fe, Hf, In, Mo, Ni, Si, Sn, or Ta and an selective alloys of thereof.

The heat dissipation plate 110 may include a plurality of heat dissipation fins 113. The plurality of heat dissipation fins 113 may increase the heat dissipation region and improve the heat dissipation efficiency. The heat dissipation plate 110 may include a plurality of case coupling portions 118 and 119 for coupling to a case (not shown).

The heat dissipation plate 110 includes a heat dissipation body 111, a plurality of heat dissipation fins 113 disposed under the heat dissipation body 111, a recess region 112 on the heat dissipation body 111, and a plurality of case coupling portions 118 and 119 disposed on the outer portion of the heat dissipation body 111.

As shown in FIG. 2, the heat radiating plate 110 may be formed such that the length X1 of the first axial direction X is longer than the width Y1 of the second axial direction Y. The first axial direction X may be a longitudinal direction and a direction orthogonal to the second axial direction Y. The length X1 of the heat dissipation plate 110 may be at least two times of the width Y1. For example, the length X1 may be 2 to 4 times of the width Y1, wherein the length X1 and the width Y1 may vary depending on the type of the lighting.

A bottom of the recess region 112 of the heat dissipation plate 110 may be disposed deeper or stepped than an outer peripheral region thereof. The recess region 112 of the heat dissipation plate 110 may be a concave region or a stepped region. A heat dissipation pad 160 and a printed circuit board 171 are disposed in the recess region 112. The bottom of the recess region 112 may be disposed on a flat surface. The bottom of the recess region 112 of the heat dissipation plate 110 is formed as a flat surface so that the lower surface of the heat dissipation pad 160 may be in surface contact with the bottom of the recess region 112, and a conduction efficiency of heat conducted from the heat radiating pad 160 may be improved.

Figure 21:
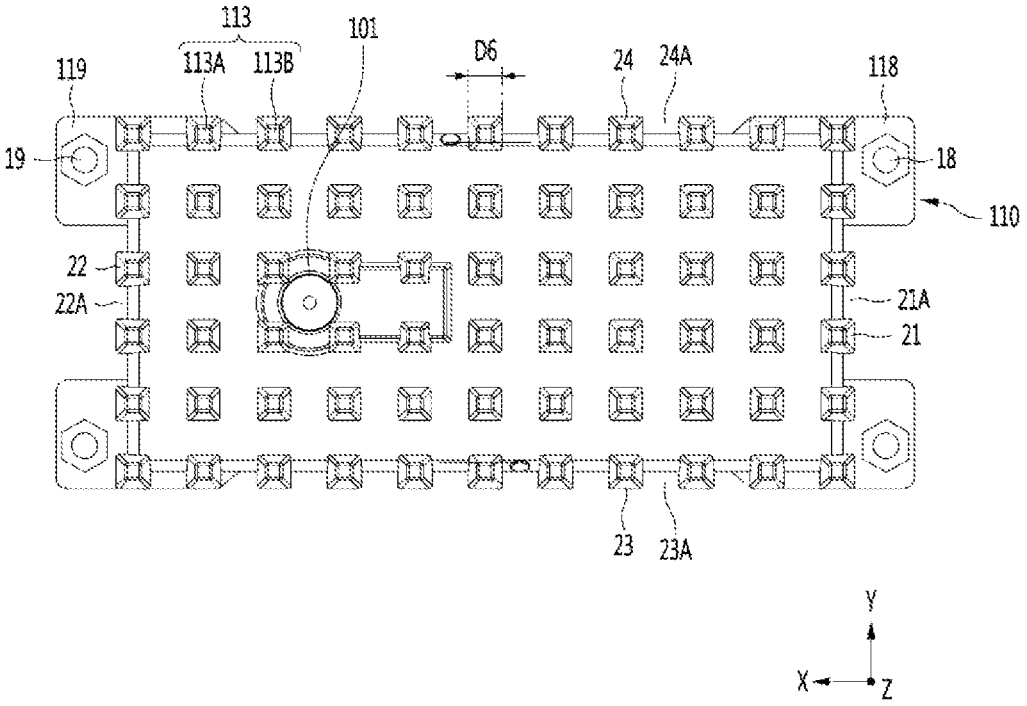
FIG. 21 is a bottom view of the lighting module of FIG. 10.

The plurality of heat dissipation fins 113 may protrude downward in the vertical direction from the heat dissipation plate 110, for example, the heat dissipation body 111, and may be arranged at a predetermined interval. For example, the heat dissipation fin 113 may be arranged in a dot-like matrix or a lattice shape when viewed from the bottom view, as shown in FIG. 21. The interval between the plurality of heat dissipation fins 113 may be regular or irregular. The heat radiating fins 113 are arranged at regular intervals for uniform heat dissipation. Here, the cable 101 may be freely drawn out in the X axis direction or the Y axis direction through a plurality of heat dissipation fins 113, as shown in FIG. 21. Each of the heat dissipation fins 113 may have a columnar shape, for example, a polygonal shape or a circular column shape. Each of the heat dissipation fins 113 may be formed to have a smaller thickness or width as the heat dissipation body 111 is farther from the heat dissipation body 111, but the present invention is not limited thereto.

As shown in FIGS. 1 and 2, the heat dissipation body 111 may include a plurality of guide ribs 11, 12, 13, 14 and 15 on the outer side of the first region. The plurality of guide ribs 11, 12, 13, 14 and 15 may function as sidewalls around the recess region 112.

The plurality of guide ribs 11, 12, 13, 14 and 15 may include a first guide rib 11 disposed around the recess region 112 and a second guide rib 12, 13, 14 and 15 disposed outside the first guide rib 11. The first guide rib 11 may protrude from the horizontal bottom surface of the recess region 112 to a predetermined height around the recess region 112. For example, the first guide ribs 11 may be formed in a ring shape or a frame shape to surround the circumference of the recess region 112. The first guide rib 11 includes a plurality of convex portions 11A and a concave portion 11B. The plurality of convex portions 11A are disposed along the circumference of the recess region 112 and protrude convex toward the center of the recess region 112. The concave portion 11B is disposed between the convex portions 11A. Each of the convex portions 11A may provide a space for the coupled portion 121 for coupling the coupling means.

The heat dissipation pad 160 and the printed circuit board 171 of the light emitting module 170 are coupled to the recess region 112. The first guide ribs 11 are disposed to correspond to the side surfaces of the heat radiating pad 160 and the printed circuit board 171. The first guide ribs 11 may be disposed between the printed circuit board 171 and the waterproof frame 140. The first guide ribs 11 may be selectively in contact with each of side surfaces of the printed circuit board 171. The convex portion 11A and the concave portion 11B of the first guide rib 11 may prevent the heat radiation pad 160 and the printed circuit board 171 from rotating or being separated from each other, and may be combined with the components that are coupled to the recess region 112.

The upper end of the first guide ribs 11 may be disposed at a lower height than the upper surface of the printed circuit board 171. The first guide ribs 11 may press the printed circuit board 171 toward the heat radiating plate 110 when the second couple mean 109 is coupled.

The second guide ribs 12, 13, 14 and 15 are disposed outside the first guide ribs 11 as shown in FIGS. 2 and 8. The second guide ribs 12, 13, 14 and 15 are disposed outside the waterproof frame 140 and the cover 190. The second guide ribs 12, 13, 14 and 15 guide the waterproof frame 140 and the cover 190. The second guide ribs 12, 13, 14 and 15 include a plurality of ribs spaced from each other. The second guide ribs 12, 13, 14 and 15 include first and second ribs 12 and 13 facing each other on both sides of the heat dissipation body 111 in the first axial direction X, and third and fourth ribs 14 and 15 facing each other on both sides of the second axis direction Y of the first housing 111. Each of the first and second ribs 12 and 13 has a linear length equal to the width Y1 of the heat dissipation body 111 in the second axial direction Y, and covers an outer sides of the waterproof frame 140 and the cover 190. Each of the third and fourth ribs 14 and 15 may have a length smaller than the length X1 of the heat dissipation body 111 in the first axial direction. For example, each of the third and fourth ribs 14 and 15 may be formed to have a length equal to or less than ½ the length X1 of the heat dissipation body 111 in the first axial direction, but is not limited thereto. Each of the third and fourth ribs 14 and 15 may be arranged in plural.

The case coupling portions 118 and 119 are respectively formed on the outer sides of the first and second ribs 12 and 13 opposite to each other. For example, a plurality of first case coupling portions 118 are disposed outside the first ribs 12, and a plurality of second case coupling portions 119 are disposed outside the second ribs 13. The first and second case coupling portions 118 and 119 may be formed to have a low stepped structure from the upper ends of the first and second ribs 12 and 13. The first and second case coupling portions 118 and 119 protrude from opposite sides of the heat dissipation body 111.

The printed circuit board 171 is disposed on the center region of the heat dissipation plate 110. A recess region 112 may be formed in the center region of the heat dissipation plate 110 so as to insert the printed circuit board 171 therein. A heat dissipation pad 160 may be disposed between the heat dissipation plate 110 and the printed circuit board 171. The heat dissipation pad 160 and the printed circuit board 171 may be stacked in the recess region 112.

The waterproof frame 140 may be coupled to the upper portion of the heat dissipation plate 110. The waterproof frame 140 may be coupled to an area between the first guide ribs 11 and the second guide ribs 12, 13, 14 and 15. The waterproof frame 140 may be disposed between the heat dissipation plate 110 and the cover 190.

The heat dissipation plate 110 may include a plurality of cover coupling portions 121. The plurality of cover coupling portions 121 may be disposed in different regions of the region between the first guide ribs 11 and the second guide ribs 12, 13, 14 and 15. The plurality of cover coupling portions 121 may have a lower structure than the upper ends of the first guide ribs 11 and the second guide ribs 12, 13, 14 and 15. The plurality of cover coupling portions 121 may have coupling holes 12A therein. The coupling holes 12A of the cover coupling portions 121 are disposed at positions corresponding to the coupling holes 42 of the waterproof frame 140 and the coupling holes 99 of the outer portion of the cover 190, and the second coupling means 109 may be coupled to the coupling holes 42 and 99. The second coupling means 109 includes a member such as a screw or a rivet.

Figure 18:
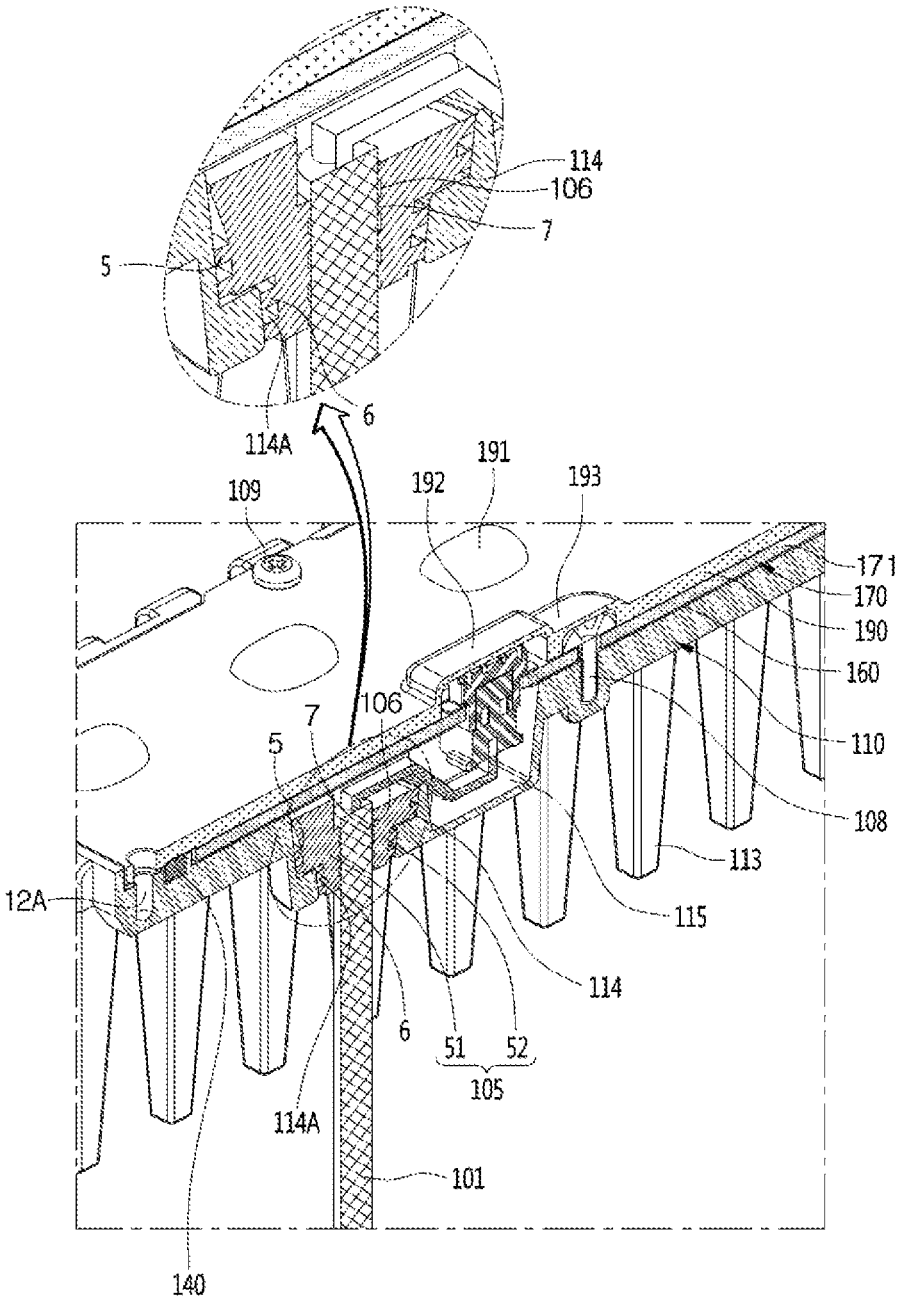
FIG. 18 is a side sectional view of the lighting module of FIG. 10.

As shown in FIGS. 2, 3 and 18, the waterproof cap 105 may be coupled to the recess region 112 of the heat dissipation body 111. The waterproof cap 105 may have a cable hole 106 and may be coupled to the first groove 114 of the heat dissipation plate 110. The recess region 112 may include a first groove 114 and a second groove 115. The first groove 114 may be coupled to the waterproof cap 105 and the second groove 115 may be connected to the first groove 114 and the second connector 107 may be disposed therein. The waterproof cap 105 may be coupled to the periphery of the cable 101. The first groove 114 and the second groove 115 may be disposed at the bottom of the heat dissipation body 111 or at a lower area than the bottom of the recess region 112. The first groove 114 and the second groove 115 are disposed inside the heat dissipation body 111 and are disposed in a concave shape with respect to the bottom of the recess region 112. The first grooves 114 may be arranged in a stepped structure having an upper width larger than a lower width. Accordingly, the structure of the first groove 114 may provide a long infiltration path of moisture.

Figure 4:
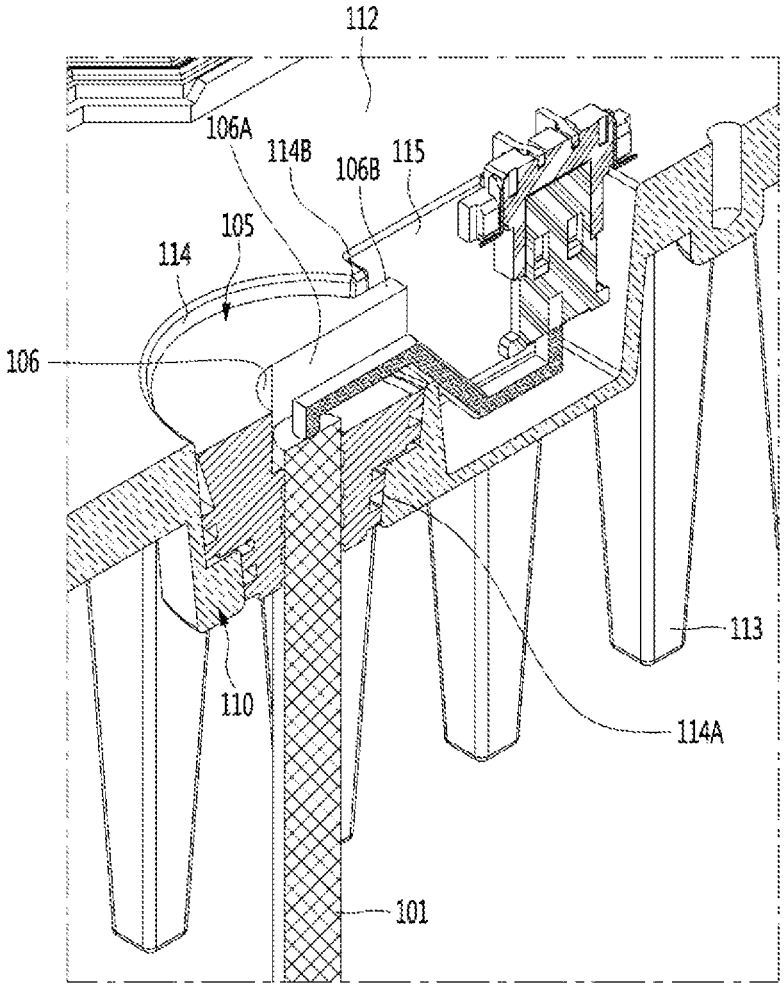
FIG. 4 is a cross-sectional side view of the heat dissipation and the waterproof cap of FIG. 3.

The waterproof cap 105 includes a rubber material and may be coupled to the first groove 114. As shown in FIG. 5, the waterproof cap 105 includes a first waterproof structure 51 and a second waterproof structure 52, and the first waterproof structure 51 and the second waterproof structure 52 include a stepped structure having a different width of a lower portion and an upper portion. The waterproof cap 105 may include a shape in which the upper width C1 of the first waterproof structure 51 is wider than the lower width C2 of the second waterproof structure 52. The first groove 114 may have a structure in which the outer shape of the waterproof cap 105 may be inserted. The width C1 of the first waterproof structure 51 of the waterproof cap 105 may become gradually narrower toward the lower direction and the width C2 of the second waterproof structure 52 may gradually increase toward the upper direction. Here, a lower end of the second waterproof structure 52 are spaced apart from the lower end of the first waterproof structure 51 by a predetermined distance C3, and an outer region between the second waterproof structure 52 and the first waterproof structure 51 may be provided in a stepped structure. As shown in FIGS. 3 and 4, the waterproof cap 105 may be fitted to the first groove 114. The lower part of the first groove 114 may be formed with a hole 114A passing through the heat dissipation plate 110. The second waterproof structure 52 of the waterproof cap 105 is coupled to the hole 114A. The lower surface of the waterproof cap 105 may be exposed on the lower surface of the heat dissipation plate 110.

Here, at least one of the outer surface of the waterproof cap 105 or the surface of the first groove 114 may include a protrusion or a groove structure to prevent moisture penetration. For example, the waterproof cap 105 may include one or a plurality of ring-shaped protrusions 5 and 6. The ring protrusions 5 and 6 may be disposed on at least one of the first waterproof structure 51 and the second waterproof structure 52. For example, the waterproof cap 106 may include a first ring protrusion 5 on the surface of the first waterproof structure 51 and a second ring protrusion 6 on the surface of the second waterproof structure 52.

The first ring protrusions 5 are formed in a ring shape having different outer diameters and the second ring protrusions 6 may be formed in a ring shape smaller than the outer diameter of the first ring protrusions 5 and having different outer diameters. The first and second ring protrusions 5 and 6 may be in close contact with the surface of the first groove 114 with a predetermined elasticity. The first ring protrusion 5 of the first waterproof structure 51 may have an outer diameter larger than the outer diameter of the second ring protrusion 6 of the second waterproof structure 52.

The cable 101 is disposed in the first groove 114. A cable hole 106 is disposed in the center region of the waterproof cap 105 and a third ring protrusion 7 may be disposed on the surface of the cable hole 106. The third ring protrusion 7 may be formed of a plurality of rings having the same inner diameter. A plurality of the third ring-shaped protrusions 7 are arranged in the vertical direction so that they may come into tight contact with the surface of the cable 101 with elastic force. Accordingly, the waterproof cap 105 may prevent moisture from penetrating through the cable hole 106 and the first groove 114. The regions 54 and 55 between the third ring protrusions 7 in the vertical direction in the first and second waterproof structures 51 and 52 of the waterproof cap 105 are located outside the third ring protrusion 7 and may have a larger width than the interval between the third ring-shaped protrusions 7. The uppermost protrusion of the third ring protrusion 7 may be disposed above the cable hole 106 rather than the region 54 and 55.

The waterproof cap 105 may include a guide groove 106A connected to the cable hole 106. The direction of the guide groove 106A in the waterproof cap 105 may be arranged to be connected to the second groove 115. When the cable 101 is inserted into the cable hole 106 of the waterproof cap 105, the cable 101 is bent along the guide groove 106A and may be connected to the second connector 107 which is disposed at the second groove 115. The second groove 115 may be formed at a depth smaller than the depth of the first groove 114 having the hole 114A. The second groove 115 may be formed in a concave shape that does not penetrate the heat dissipation plate 110.

The waterproof cap 105 includes a latching protrusion 106B and the heat dissipating plate 11 may include a latching protrusion 114B adjacent to the first groove 114. The latching protrusion 106B may be coupled to the latching protrusion 114B for preventing rotation. The latching protrusion 106B protrudes from the waterproof cap 105 in the direction of the second groove 115. The latching protrusion 106B protrudes from the first waterproofing structure 51 toward the second groove 115. The latching protrusion 106B is sandwiched between the latching protrusions 114B extending between the first groove 114 and the second groove 115 to prevent the waterproof cap 105 from rotating. The latching protrusion 114B may protrude from the heat dissipation body 111 to a region between the first groove 114 and the second groove 115.

As shown in FIG. 1 and FIG. 6B, the waterproof frame 140 may be coupled to the heat dissipation plate 110. The waterproof frame 140 includes a pad hole 141 therein and the pad hole 141 may be opened to allow the heat dissipation pad 160 to be inserted therein. The heat dissipation pad 160 may be inserted through the pad hole 141.

The waterproof frame 140 includes a protrusion 41A protruding in the center direction of the pad hole 141 and a recessed portion 41B recessed outside the protrusion 41A. The protrusions 41A and the recesses 41B may be disposed along the first guide ribs 11 of the heat dissipation plate 110. The heat dissipation pad 160 is disposed in the recess region 112 of the heat dissipation plate 110 through the pad hole 141. The first guide rib 11 is formed in the heat dissipation pad 160, and is disposed in an area between the frames 140.

As shown in FIGS. 1, 6A and 6B, the waterproof frame 140 may include waterproof protrusions 145 and 146. The waterproof protrusions 145 and 146 may be disposed on a region between the first guide ribs 11 and the second guide ribs 12, 13, 14, and 15. The waterproof protrusions 145 and 146 may include a first waterproof protrusion 145 protruding from the waterproof frame 140 in the bottom direction of the cover 190 and a second waterproof protrusion 146 protruding in the direction of the top surface of the heat dissipation plate 110. The first and second waterproof protrusions 145 and 146 protrude in directions opposite to each other. The first and second waterproof protrusions 145 and 146 may be vertically overlapped with each other. Since the first and second waterproof protrusions 145 and 146 are arranged to overlap with each other in the vertical direction, the waterproof effect may be maximized. Each of the first and second waterproof protrusions 145 and 146 may be formed as a single waterproof structure or a double waterproof structure depending on the number, and may be double waterproof structure, for example, two or three waterproof protrusions. At least one or both of the first and second waterproof protrusions 145 and 146 may be formed in a continuous ring structure along the periphery of the first guide rib 11. The first and second waterproof protrusions 145 and 146 may be in contact with the cover 19 and the heat radiating plate 110.

When the cover 190 is coupled, the first and second waterproof protrusions 145 and 146 may provide an elastic force and a repulsive force to the interface between the cover 190 and the heat dissipation plate 110 to effectively perform waterproofing.

Figure 19:
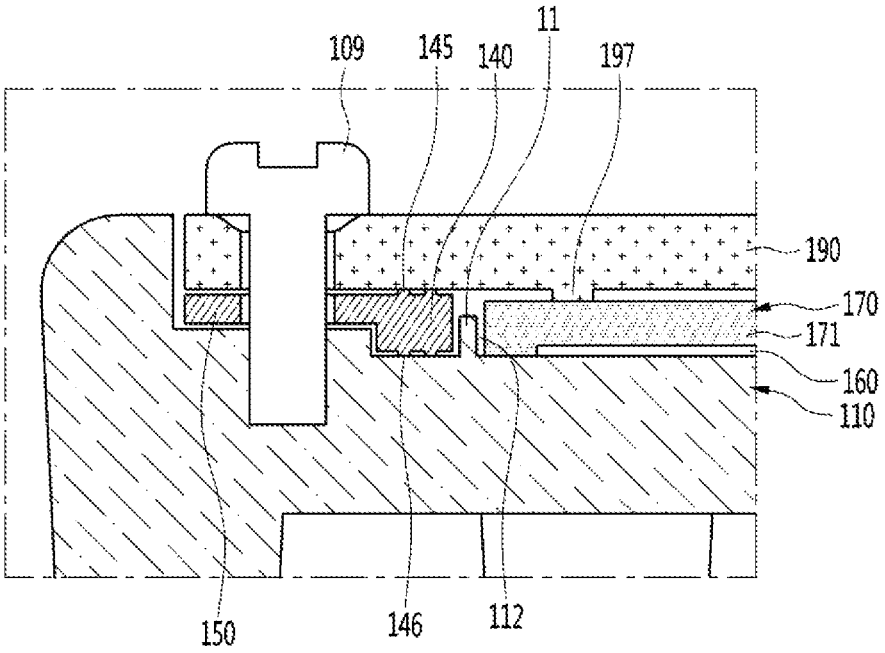
FIG. 19 is a partial side cross-sectional view of the lighting module of FIG. 10.

As shown in FIGS. 18 and 19, the lower surface of the cover 190 and the upper surface of the heat dissipation plate 110 may be in contact with each other. Accordingly, since the cover 190 is in contact with the heat dissipation plate 110, moisture may be prevented from penetrating through the outer interface.

Referring to FIGS. 1, 7 and 8, the waterproof frame 140 is disposed on the first region of the heat dissipation plate 110. The waterproof frame 140 includes a plurality of cover coupling portions 142 around the outer periphery thereof. The cover coupling portion 142 may be provided with a coupling hole 42 for coupling the coupling means.

The cover coupling portion 142 of the waterproof frame 140 is disposed at a position corresponding to the cover coupling portion 121 of the heat dissipation plate 110. When the cover 190 is coupled by the second coupling means 109, the waterproof frame 140 is coupled to the heat radiating plate 110 in a state of being in close contact with the heat radiating plate 110. The waterproof frame 140 may prevent moisture from penetrating through the interface between the waterproof frame 140 and the heat dissipation plate 110. In addition, a moisture penetration by the first and second waterproof protrusions 145 and 146 disposed on the upper and lower surfaces of the waterproof frame 140 may be blocked.

As another example, the waterproof protrusions 145 and 146 may not be provided on the waterproof frame 140, and waterproof protrusions may be disposed on the upper surface of the heat dissipation plate 110 and the lower surface of the cover 190. The waterproof protrusions disposed on the upper surface of the heat dissipation plate 110 and the lower surface of the cover 190 may prevent water infiltration by pressing the upper and lower surfaces of the waterproof frame 140. As another example, a waterproof ring may be provided on the upper surface of the heat dissipation plate 110 and the lower surface of the cover 190, and may be fitted between the first and second waterproof protrusions 145 and 146 of the waterproof frame 140.

The first waterproof protrusion 145 may be disposed on at least one of the upper surface of the waterproof frame 140 and the lower surface of the cover 190. The second waterproof protrusion 146 may be disposed on and may be formed on at least one of the lower surface of the waterproof frame 140 of the heat dissipation plate 110.

Figure 10:
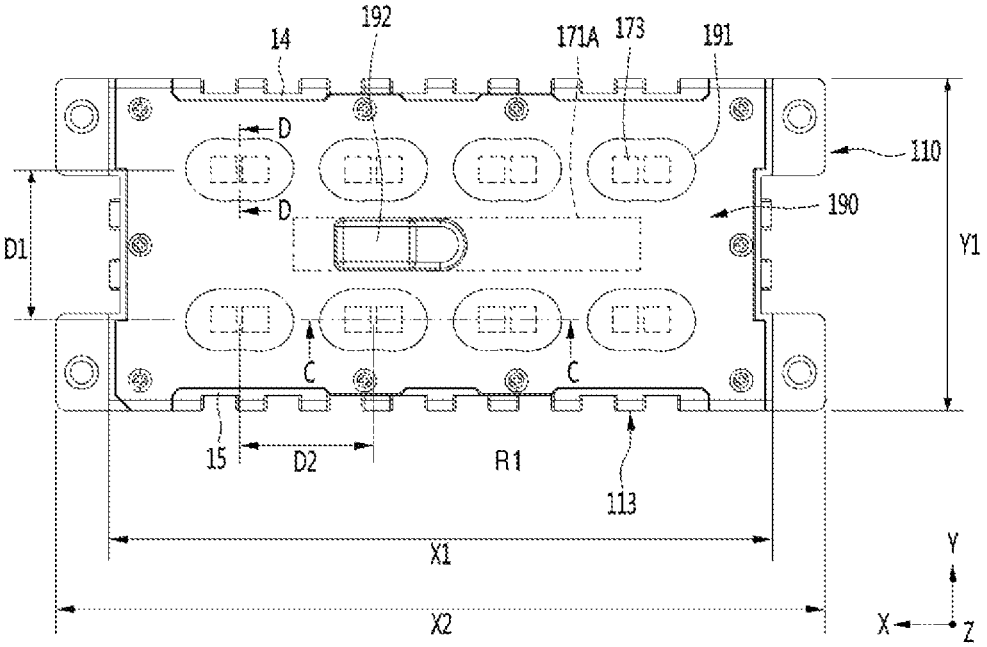
FIG. 10 is a perspective view showing a light emitting device in the lighting module of FIG. 9.

FIG. 18 is a side sectional view of the lighting module of FIG. 10. As shown in FIGS. 1 and 18, the heat radiating pad 160 is disposed between the heat radiating plate 110 and the printed circuit board 171. The heat dissipation pad 160 is inserted into the recess 112 of the heat dissipation plate 110. The heat radiating pad 160 may include a resin material such as a silicon material. Since the heat dissipation pad 160 is an elastic material capable of being pressed, and a contact area with the printed circuit board 171 may be increased when the heat dissipation pad 160 is compressed. Accordingly, the heat transmitted from the printed circuit board 171 may be uniformly conducted and conducted to the heat dissipation plate 110. The thickness of the heat radiating pad 160 may be thinner than that of the printed circuit board 171. The lower surface of the heat radiating pad 160 may have the same area as the lower surface of the printed circuit board 171 or may have an area smaller than the lower surface of the printed circuit board 171.

A connector hole 162 and a coupling hole 163 may be formed in the heat dissipation pad 160 and a second connector 107 connected to the cable 101 may be inserted into the connector hole 162.

As shown in FIGS. 1 and 7, the light emitting module 170 includes a printed circuit board 171 and at least one light emitting device 173. The printed circuit board 171 includes at least one of a resin material PCB, a metal core PCB (MCPCB), and a flexible PCB (FPCB), and may be provided as a metal core PCB for heat radiation, for example. The metal core PCB has a circuit pattern layer on the top, a metal layer on the bottom, and an insulating layer between the metal layer and the circuit pattern layer. The thickness of the metal layer may be 70% or more of the thickness of the printed circuit board 171 to improve the heat radiation efficiency, but the present invention is not limited thereto. The printed circuit board 171 may include a circuit for an AC module, and may be selectively used in an AC power mode or a circuit for a DC module. However, the present invention is not limited thereto.

The printed circuit board 171 is disposed between the cover 190 and the heat radiating pad 160. The printed circuit board 171 is contacted between the cover 190 and the heat radiating pad 160. As shown in FIGS. 2 and 7, the periphery of the printed circuit board 171 corresponds to the first guide ribs 11 of the heat dissipation plate 110. The printed circuit board (171) includes a plurality of recesses 71, 72, 73, and 74, the plurality of recesses 71, 72, 73, and 74. The plurality of recesses 71, 72, 73, and 74 may be concave in the center direction of the printed circuit board 171. The areas of the recesses 71, 72, 73, and 74 may correspond to the cover coupling portion 121 of the heat dissipation plate 110.

A first connector 175 may be coupled to the printed circuit board 171. The first connector 175 may be coupled to at least one of the upper surface and the lower surface of the printed circuit board 171. For example, the first connector 175 may pass through a connector hole in the printed circuit board 171 and may be connected to a circuit pattern on the upper surface of the printed circuit board 171. The first connector 175 may be coupled to the second connector 107 and electrically connected thereto.

A coupling hole 79 may be formed in the center region of the printed circuit board 171. The first coupling means 108 may be coupled to the heat dissipation 11 through the coupling holes 79 of the printed circuit board 171 and the coupling holes 163 of the heat dissipating pad 160. Accordingly, the center side flow of the printed circuit board 171 may be prevented, and the contact area with the heat radiating pad 160 may be improved. The first coupling means 108 may be a single piece and may fix the minimum number of printed circuit boards 171.

One or more light emitting devices 173, for example, a plurality of light emitting devices 173 may be arranged in a dot pattern. The plurality of light emitting devices 173 may be arranged in one or more rows, for example, two or more rows. Here, each row of the light emitting devices 173 may be the longitudinal direction X of the heat dissipation plate 110.

The light emitting device 173 may be implemented as two or more light emitting chips under each lens portion 191, or may be implemented in two or more packages. The light emitting chip may emit light of at least one of blue, red, green, and UV. The light emitting device 173 may emit at least one of white, blue, red, and green, and may emit white light for illumination.

The interval D1 between the rows and the columns of the lens portion 191 may be wider than the interval D2 between the rows and is not limited thereto. The interval D2 between the rows of the lens portions 191 may be equal to the distance between the rows of the light emitting devices 173 when the light emitting devices 173 are arranged in two rows. The interval D1 may be the minimum distance between the centers of the lens portions 191 spaced apart in the second axial direction Y or the minimum distance between the centers of the light emitting devices disposed under the lens portions 191 of adjacent rows. The interval D2 may be the minimum distance between the centers of the lens portions 191 spaced apart in the first axial direction X or the minimum interval between the centers of the light emitting devices disposed under the lens portion 191 of the adjacent row have.

As shown in FIGS. 1, 7 and 8, the cover 190 may include a plurality of lens portions 191. Each of the lens portions 191 protrudes on the cover 190 to cover the each of the light emitting devices 173. Since each of the lens portions 191 includes a shape in which a first axial direction X and a second axial direction Y orthogonal to the central axis have different lengths and have a curved surface, it is possible to provide wide distribution of an orientation angle distribution of the light in the length direction. M rows (M≥2) of the lens portions 191 are arranged in the first axis direction and N columns (N≥2, M>N) of the lens portions 191 are arranged in the second axis direction.

The cover 190 may include a transparent resin material such as silicon or epoxy or at least one of an acrylic resin series such as glass or polymethyl methacrylate (PMMA), polyethylene terephthalate (PET), polycarbonate (PC), cycloolefin copolymer (COC) and a polyethylene naphthate late (PEN) resin. As another example, the cover 190 may include, an opaque material according to purposes, but is not limited thereto. The lens portion 191 may be integrally formed of the same material as the cover 190. A reflective resin may be applied to the surface of the cover 190 excluding the lens portion 191 to improve light reflection efficiency.

Referring to FIG. 10, In the case of AC driving, the number of the light emitting devices 173 may vary according to the driving voltage of the LED, but it must be at least 16 or more. If the lens portion 191 of the cover 190 is disposed on one light emitting device 173 in the case of an AC power source (for example, AC 220 V), the lens portions 191 of each row may be concentrated so that optical interference between the lens portions 191 may be generated. For example, when six or more lens portions 191 are arranged in the respective rows of the cover 190, it may be difficult to secure a gap between the adjacent lens portions 191. In addition, in the case of AC driving, the printed circuit board 171 may be provided with a circuit portion (171A in FIG. 10) as an AC circuit in a center region between the row and the row on which the light emitting device 173 is mounted.

The lens portion 191 may be arranged in two rows on both sides of the center by disposing a circuit portion 171A on the center side of the printed circuit board 171. The size of the cover 190 may be determined by the size of the heat radiating plate 110 The number of lens portions 191 that may be arranged in each column is limited in consideration of the interference between the lens portions 191. For example, the size of the heat dissipating plate 110 may be set to be in a range of 140 mm to 160 mm in the horizontal length X2 and in a range of 55 mm to 75 mm in the vertical length Y1, The maximum number of mounts of the light emitting devices 191 must be reduced and the number of the light emitting devices 173 which may be arranged in the region of the lens portion 191 of each column is inevitably increased. The number of the lens portions 191 of the cover 190 may be less than six in each column and the number of the light emitting devices 173 under each lens portion 191 may be two or more.

The plurality of lens portions 191 may be arranged in the first axial direction X and the number of the plurality of the lens portions 191 may be larger than the number of rows arranged in the second axial direction Y. This is because when a plurality of lens portions 191 are arranged on a predetermined space, for example, a plurality of lens portions 191 arranged in the first axial direction X may be necessary to provide an interval which does not generate optical interference between adjacent lens portions 191. The interval R5 between the lens portions 191 may vary depending on the length R1 in the X axis direction of the lens portion 191 and the height H1 of the lens portion 191.

Figure 11:
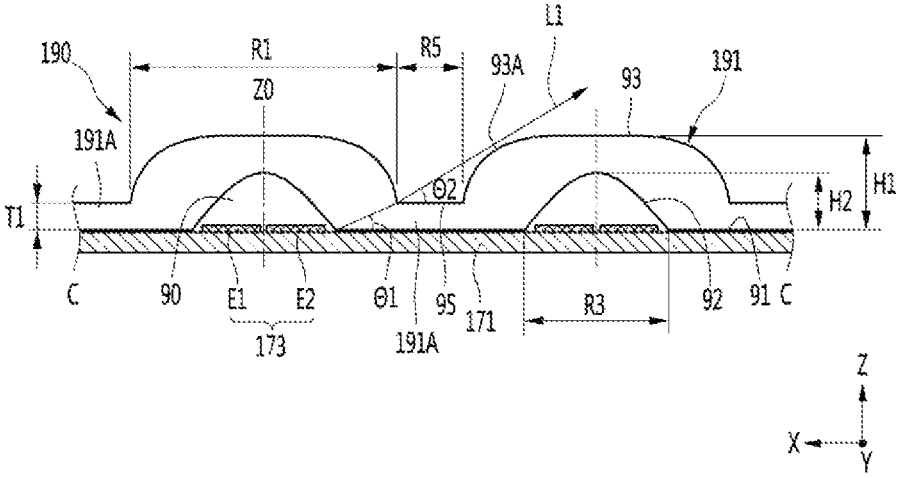
FIG. 11 is a cross-sectional side view on the C-C side of the lighting module of FIG. 10.
Figure 12:
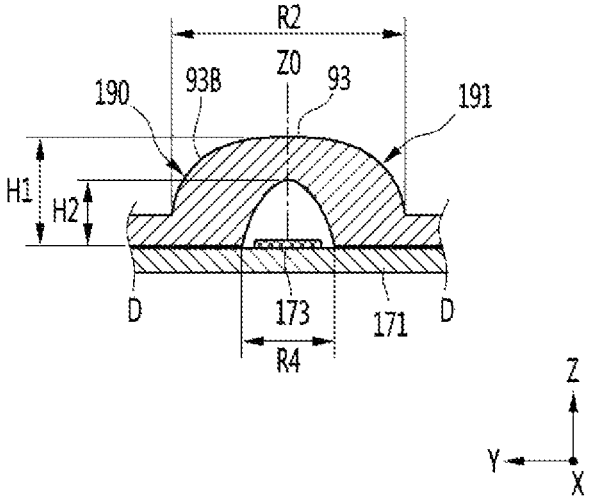
FIG. 12 is a cross-sectional side view on the D-D side of the lighting module of FIG. 10.

FIG. 11 is a cross-sectional view on a C-C side of the light emitting module and the cover of FIG. 10, and FIG. 12 is a sectional view on a D-D side of the light emitting module and the cover of FIG. 10.

As shown in FIGS. 11 and 12, each of the plurality of lens portions 191 includes a curved surface in which the output surfaces 93 and 93A are curved. The first and the second axial directions X and X2 perpendicularly intersect with the center axis Z0, and the lengths R1 and R2 of the second axial direction Y may be different from each other. The output surface 191 of the lens portion 191 may have a concave portion 93B having a curved surface in which the exit area in the first axial direction is convex and concave in the exit area in the second axial direction. The concave portion 93B disposed in the second axial direction of the output surface 191 of the lens portion 191 may be disposed on either one side or both sides in the second axial direction. The concave portion 93B may be disposed between the convex curved surfaces in the second axial direction of the output surface 93A. The convex curved surfaces in the second axial direction may be continuously connected from the convex curved surfaces in the first axial direction. Here, when the concave portions 93B of the output surface 93A are disposed on both sides in the second axial direction, the depths of the both concave portions 93B may be different from each other. This makes it possible to form the concave portion 93B in the direction in which light is irradiated deeper, and it is possible to irradiate light with a wide oriented angle distribution.

Each of the lens portions 191, for example, may be arranged such that the length R1 of the first axis direction X is larger than the length R2 of the second axis direction Y.

Figure 13:
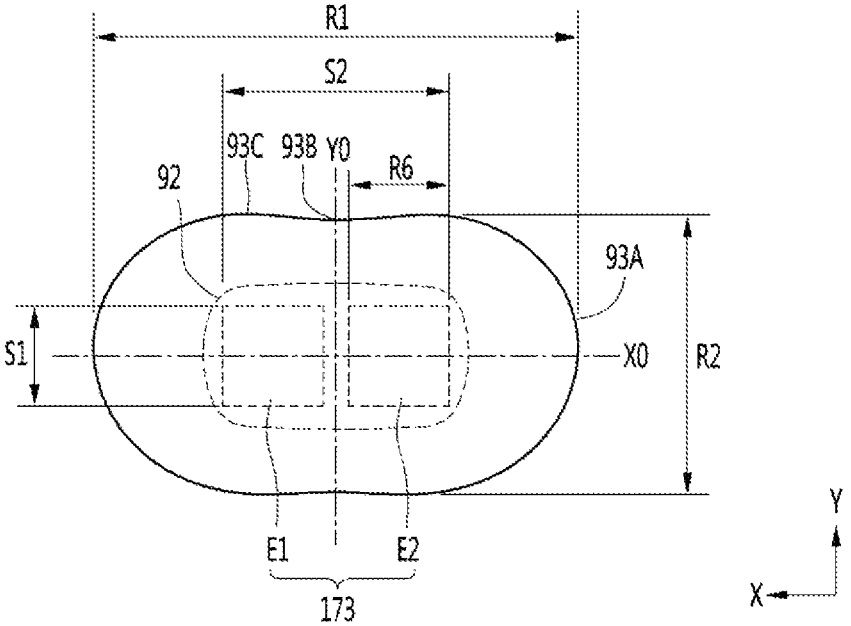
FIG. 13 is a detailed view of the lens portion of the cover in the lighting module of FIG. 11.

As shown in FIG. 13, each of the plurality of lens portions 191 may have a shape in which two convex lenses are superimposed in the first axial direction X with respect to the center axis Z0, the shape of the hemispherical shape may be superimposed in the first axial direction X. The lens portion 191 is formed so as to be in contact with two convex lenses or hemispherical shapes on the outside of the center region 93 out of the output surfaces 93 and 93A in the second axial direction Y, and a concave portion 93B that is recessed in the direction of the central axis Z0 may be formed. The outer shape of each of the lens portions 191 may be a shape in which the peanut shell shape is cut in half in the longitudinal direction. The concave portion 93B may be disposed further inside than the two hemispherical outlines 93C.

The lens portion 191 may be a convex or flat surface in the center region 93 passing through the center axis Z0 of the output surfaces 93 and 93A and may have a curved surface having a sharp inclination in the side region 93A between the center region 93 of the lens portion 191 and the edge.

As shown in FIGS. 11 and 12, each of the lens portions 191 includes a recess 90 recessed on the bottom 91 of the cover 190 and an incident surface 92 around the recess 90. The recess 90 may have a shape that gradually narrows toward the high point of the incident surface 92, and the incident surface 92 has a hemispherical or aspherical shape. The bottom of the recess 90 may be arranged such that the length R3 is longer than the width R4. This is because the plurality of light emitting devices E1 and E2 are arranged along the bottom length R3 of the recess 90 in the first axial direction so that they may be disposed longer than the bottom width R4. The height H2 of the recess 90 may be at least ½ of the height H1 of the lens portion 191, for example, in the range of ⅓ to ½ of the height H1 of the lens portion 191. If the height H2 of the recess 90 is lower than the above range, the light loss may be large. If the height H2 is larger than the above range, the light distribution in the center direction and the side direction may not be uniform. The incident surface 92 may have a different curvature from the first axis direction to the second axis direction, but the present invention is not limited thereto. The recess 90 may be filled with air, but is not limited thereto.

The length R1 in the x-axis direction of the lens portion 191 may be larger than the width R2 in the Y-axis direction and may be 1.8 times or more of the width R2, for example, 1.8 times to 2.2 times. The length R1 of the lens portion 191 is longer than the width R2 of the lens portion 191 so that each lens portion 191 may provide a wide illumination area along the first axis direction.

The length R1 of the lens portion 191 may be in a range of 24 mm or less, for example, 20 mm to 22 mm. If the length R1 of the lens portion 191 exceeds the above range, there is a problem that the number of the lens portions 191 is reduced or the gap between the lens portions 191 is difficult to secure. If the length R1 is less than the above range, a difference in luminous intensity between the region of the portion 191 and the region other than the lens portion 191 may be generated. The width R2 of the lens portion 191 is a length of the second axial direction Y orthogonal to the center axis Z0 and may be arranged in a range of 13 mm or less such as 9 mm or more and 12 mm or less. The width R2 of the lens portion 191 may not be considered with respect to the interval in the second axial direction Y but the shape of the lens portion 191 may be deformed when the width R2 is smaller than the above range light control may be difficult, and if it is larger than the above range, the concave portion (93B in FIG. 13) which is the hemispherical boundary portion of the lens portion 191 may not be concave and the directivity characteristic using two hemispherical shapes may not be displayed.

The height H1 of the lens portion 191 may be set to be ¼ or more of the length R1 of the lens portion 191, for example, in the range of ⅓ to ½.5 of the length R1 of the lens portion 191. When the height H1 of the lens portion 191 is less than the above range, the directivity may not be improved due to the deformation of the lens shape. When the height H1 of the lens portion 191 is larger than the above range, optical interference between the first and second portions 191 may be generated.

The lens portions 191 may be disposed to protrude from the cover body 191A and the cover body 191A may connect the lens portions 191 in a flat sheet form. The thickness T1 of the cover body 191A may be the same as the thickness of the cover 190 and may be in a range of 3 mm or less such as 1 mm to 2 mm. If the thickness T1 of the cover body 191A is smaller than the range, moisture may penetrate and deformation due to expansion or contraction may occur. When the thickness T1 of the cover body 191A is larger than the above range, the height H1 of the lens portion 191 increases with the loss of material.

Each of the lens portions 191 receives light emitted from two or more light emitting devices 173 (E1, E2) in the recess 90 through the incident surface 92 and refracts and exits the light through the output surfaces 93. Here, when the lens portion 191 is configured such that the light L1 emitted to the lower region of the incident surface 92 or the edge region adjacent to the incident surface 92 is reflected by the light output surface 93A of the lens portion 191 and the upper surface of the cover body 191A, the emitted light L2 must be refracted above the adjacent lens portion 191 so that the interference between the lens portions 191 may be reduced.

The first angle θ1 of the light L2 incident on the edge region of the incident surface 92 of the lens unit 191 is 30 degrees or less, for example, 20 degrees to 30 degrees with respect to a horizontal axis (for example, the X axis direction) on a bottom 191 of the cover 190, and the second angle θ2 of the light L1 emitted through the edge region of the exit surface 93A of the lens portion 191 may be more than 30 degrees with respect to a horizontal axis (for example, the X axis direction) on the upper surface 95 of the cover 191. Here, the adjacent lens portions 191 may be spaced apart from each other with an angle smaller than the second angle with respect to a horizontal axis. The interval R5 between the lens portions 191 may be set to a minimum of 5 mm or more using the second angle θ2, the height H1 of the lens portion 191, and the length R1. Here, the intervals R5 between the lens portions 191 in the first axial direction may be equal to each other.

The Interval R5 between the lens portions 191 may be ⅕.5 or more, e.g., ⅕ or more of the interval D2 between the central axes Z0 of the lens portions 191. The interval R5 may be in a range of at least 5 mm or more, for example, 5 mm to 7 mm. If the distance R5 is narrower than the above range, optical interference may occur between adjacent lens portions 191. If the distance R5 is wider than the above range, there is a problem that all the lens portions 191 couldn't be mounted. The interval R5 between the lens portions 191 may be smaller than the height H1 and the length R1 of the lens portion 191.

Here, As shown in FIG. 10, when the width X2 of the heat dissipation plate 110 is in the range of 140 mm to 160 mm and the length Y1 of the heat dissipation plate 110 is in the range of 55 mm to 75 mm, the maximum number of lens portions 191 that may may be disposed in each of the columns of the cover 190 may be less than 6. The lens portions 191 of each column are spaced apart from each other by the interval R5 so that mutual optical interference may be reduced.

The plurality of light emitting devices 173 (E1, E2) may be arranged in one column or two columns in each of the lens portions 191, which may vary depending on the size of the light emitting devices 173. For example, when the size of the light emitting device 173 shown in FIG. 13 is large, at least two of the light emitting devices 173 may be arranged in a single row, and the length R6 of each side of the light emitting device 173 may be in a range of 4 mm or more, For example, a quadrangular shape. The interval between the lower end of the incident surface 92 and the lower end of the output surface 93A in the X axis direction is greater than the interval between the lower end of the incident surface 92 and the output surface 93B in the Y axis direction.

Figure 15:
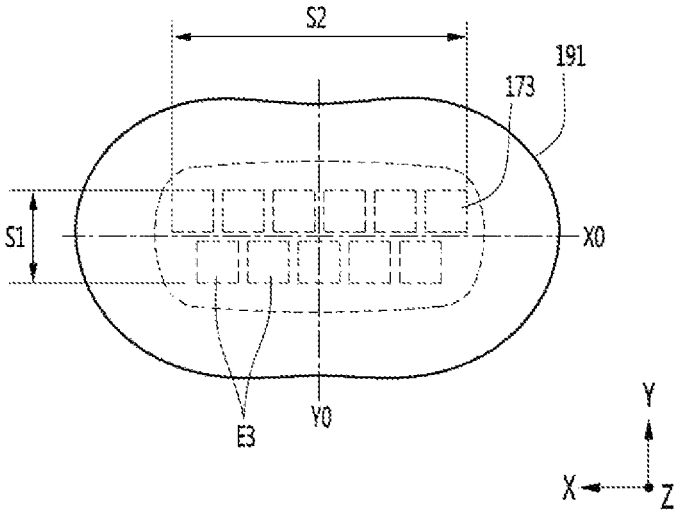
FIG. 15 is a view showing an example of arrangement of a lens portion and a light emitting device of a cover in the lighting module of FIG. 14.
Figure 16:
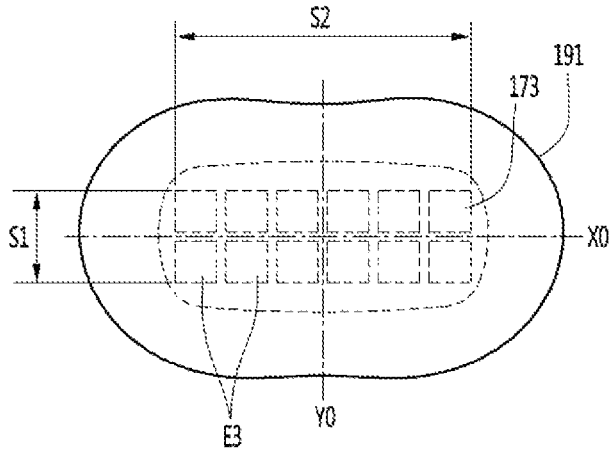
FIG. 16 is a view showing another example of the light emitting device disposed under the lens portion of the cover in the lighting module of FIG. 14.

As shown in FIGS. 15 and 16, when the size of the light emitting device 173 (E3) disposed in each of the lens portions 191 is small, the number of the light emitting devices 173 may be 10 or more, for example, a range of 10 to 14, and the size of the light emitting device 173 (E3) may be a polygonal shape for example, a square shape which has a length of each side of 1 mm or more, for example, in a range of 1 mm to 1.6 mm. The light emitting devices 173 disposed under each of the lens portions 191 may be spaced apart from each other by a predetermined distance to reduce interference or optical loss due to heat between the light emitting devices 173.

As shown in FIGS. 11 and 15 to 17, the light emitting device 173 may be disposed under each lens portion 191 and left and right symmetrically about the center Y0 in the second axis direction. The region S1×S2 of the light emitting device 173 in the lens portion 191 according to the embodiment is formed such that 2 to 14 light emitting devices are arranged in one or two rows within a range of 4.5 to 5.5 mm×10.5 mm to 11.5 mm The plurality of light emitting devices 173 may be connected to an AC power source.

Figure 14:
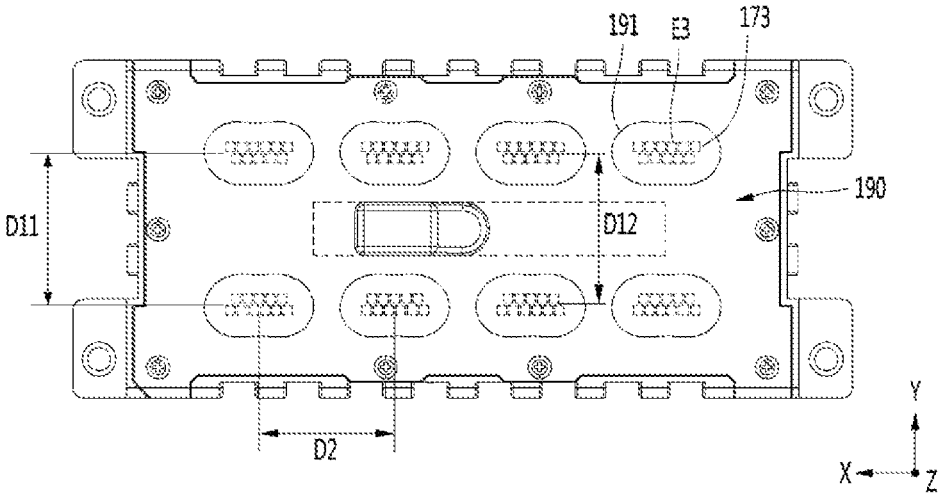
FIG. 14 is another example of the light emitting module in the lighting module of FIG. 11.

As shown in FIGS. 14 and 15, the number of the light emitting devices 173 may be arranged in the outer direction rather than the inner direction of the lens portion 191 when the number of the light emitting devices 173 (E3) under the lens portion 191 is odd. Accordingly, it is possible to cover the illumination region in the outer direction of the lens portion 191 more widely.

As shown in FIG. 16, when the number of the plurality of light emitting devices 173 is an even number, the light emitting devices may be arranged in two rows with a range of 12 to 16, and may be symmetrically arranged with respect to the center Y0 of the axial direction.

Figure 17:
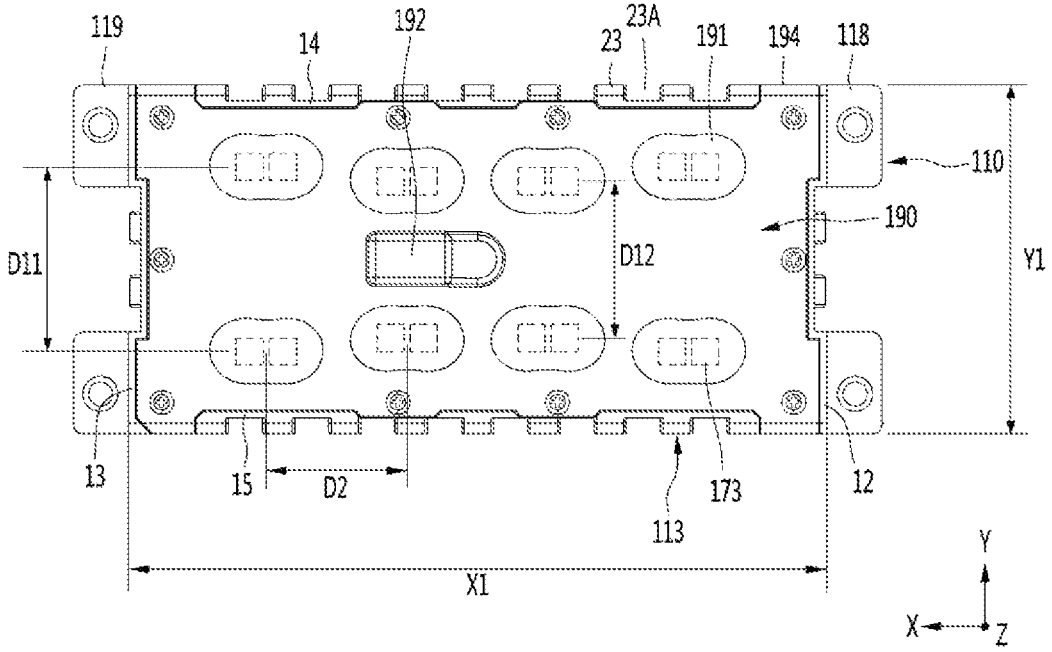
FIG. 17 is a view showing another arrangement of the lens portion of the cover in the lighting module according to the embodiment.

As shown in FIGS. 10 and 15, the centers of the lens portions 191 may be arranged on a straight line in the first axial direction X, or some lens portions may be rotated on a straight line in the first axial direction X as shown in FIG. 17. The inter-column interval D11 of the lens portions 191 may be wider than the inter-row interval D2. The center of the lens portion 191 may be arranged in each column or at least one or a plurality of the lenses may be shifted. For example, the lens portions 191 adjacent to the edge of the heat dissipating plate 110 may have a larger inter-column interval D11 than the inter-column interval D12 of the center side lens portion 191. Accordingly, the illumination intensity of the edge region could be further improved. That is, the inter-column interval D11 of the outer lens portion 191 may be wider than the inter-column interval D12 of the inner lens portion 191.

Referring to FIGS. 7 and 8, a cover coupling portion 194 is disposed around the cover 190, and coupling holes 99 may be formed in the cover coupling portion 194. The second coupling means 109 may be coupled through the coupling hole 42 of the waterproof frame 140 and the coupling hole 12A of the heat dissipation plate 110.

The cover 190 includes a first receiving portion 192 and a second receiving portion 193 which are disposed on the first connector 175 of the printed circuit board 171 and the second receiving portion 193 protrudes for the first coupling means 108 coupled to the printed circuit board 171. The first and second receiving portions 192 and 193 may protrude at different heights from each other.

The heat dissipation pad 160 and the light emitting module 170 may be stacked on the recess region 112 of the heat dissipating plate 110 according to the embodiment and then coupled by the first coupling means 108. A waterproof frame 140 is coupled to the periphery of the recess region 112 and a cover 190 is coupled to the light emitting module 170 and the waterproof frame 140, and the second coupling means 109 couples the heat dissipation plate 110 to the cover 190. Thus may be coupled to the lighting module 100 as shown in FIG. 10.

As shown in FIG. 8, the identification portion 195 may be disposed at one portion of the corner of the cover 190. The identification portion 195 may be directionally coupled to the identification protrusion 117 of the heat dissipation plate 110.

As shown in FIGS. 1 and 8, the cover coupling portion 194 of the cover 190 may be thicker than that of the cover 190. Accordingly, when the second coupling means (109 of FIG. 1) is coupled to the cover coupling portion 194, the cover coupling portion 142 of the waterproof frame 140 may be effectively pressed.

Such a lighting module 100 may prevent moisture from penetrating into the light emitting module 170. Such a lighting module 100 may be installed in an outdoor lighting apparatus, and may improve and provide a portion vulnerable to moisture.

As shown in FIG. 19, the lower protrusion 197 may be disposed on a predetermined area of the lower surface of the cover 190. The lower protrusion 197 may protrude from the lower surface of the cover 190 toward the upper surface of the printed circuit board 171. The lower protrusions 197 may be arranged in one or more than one. The lower protrusions 197 are for pressing the printed circuit board 171 toward the heat dissipation plate 110 and may be formed of the same elastic material as the cover 190. The lower protrusions 197 may be disposed closer to the outer region than to the center region of the heat dissipation plate 110.

The lower protrusions 197 may press both sides of the printed circuit board 171 toward the heat dissipation plate 110 when the cover 190 is coupled to closely contact the heat dissipation pad 160. This is because the central area of the printed circuit board 171 is coupled by a single first coupling means 108 and both side regions of the center may be pressed by the lower protrusion 197. Accordingly, the contact area between the printed circuit board 171 and the heat radiating pad 160 may be increased, and moisture penetration may be prevented.

Figure 20:
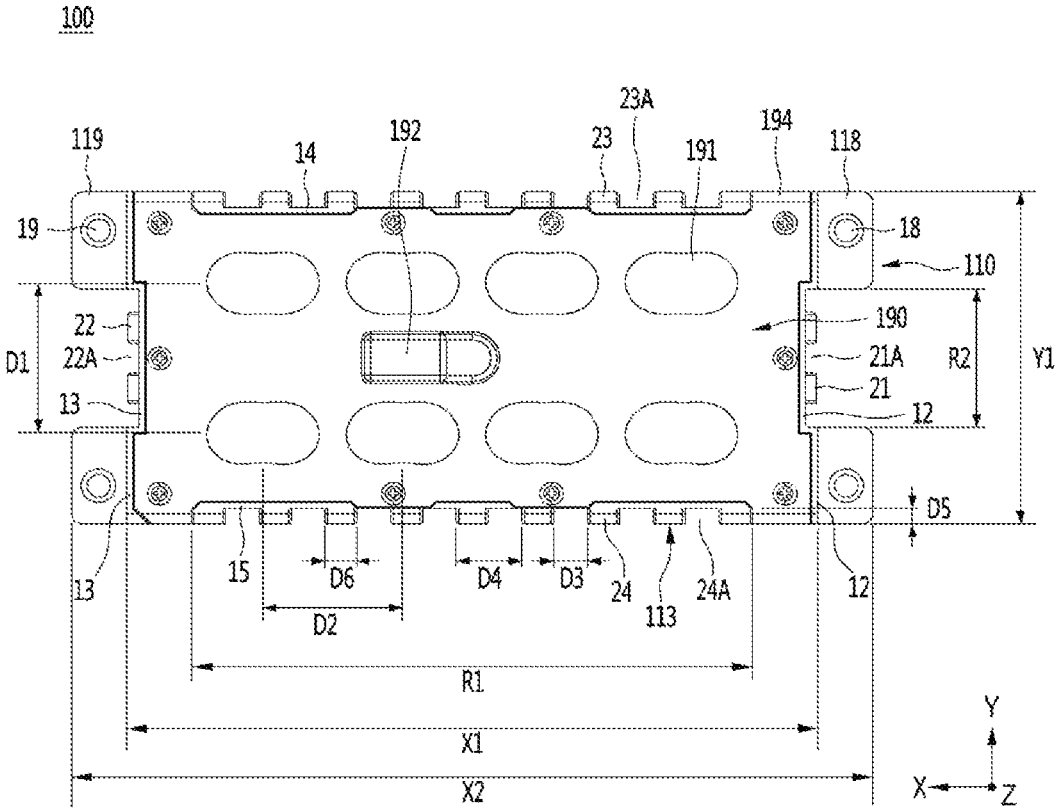
FIG. 20 is a plan view of the lighting module of FIG. 10.

FIG. 20 is a plan view of the lighting module of FIG. 10, and FIG. 21 is a bottom view of the lighting module of FIG. 10. As shown in FIGS. 20 and 21, some of the fins arranged in the edge region of the heat dissipation plate 110 may be exposed to the outside of the heat dissipation plate 110 among the heat dissipation fins 113 of the heat dissipation plate 110 according to the embodiment. For example, As shown in FIG. 21, the heat radiating fins 113 includes a first heat radiating fin 113A that is not exposed on the top view of the lighting module 100 and a second heat radiating fin 113B that is exposed on the top view may be distinguished. Alternatively, the heat radiating fin 113 may be divided into a first heat radiating fin 113A having no gap portion at the upper portion and a second heat radiating fin 113B having a gap portion at the upper portion.

As shown in FIGS. 20A and 20B, the heat dissipating plate 110 may be provided a first heat-dissipating flow path by a region between the heat dissipating fins 113 arranged at the lower portion and a first heat-dissipating flow path by gap portions 22A, 22A, 23A and 24A. The first heat-radiating flow path may be arranged in a direction in which the heat-radiating fins 113 cross each other by a dot-like matrix structure. The heat dissipation plate 110 may include protrusions 21, 22, 23, and 24 disposed on at least two sides or opposite sides of the side surfaces. The protrusions 21, 22, 23, and 24 may extend from the radiating fins 113. The protrusions 21, 22, 23, and 24 are disposed on the side surfaces of the heat dissipation plate 110, respectively. The protrusions 21, 22, 23, and 24 may be disposed in an area of the lighting module 100 or an area of the heat dissipation plate 110. The region between the projecting portions 21, 22, 23, and 24 is the second heat radiation flow path, and may be a region of the gap portions 21A, 22A, 23A, and 24A. The gap portions 21A, 22A, 23A and 24A may provide the second heat radiation flow path on each side of the heat radiation plate 110. The width D3 of each of the gap portions 21A, 22A, 23A and 24A may be larger than the width D6 of each of the protrusions 21, 22, 23 and 24, 23A, and 24A may be smaller than the width D6. The width D6 of each of the protrusions 21, 22, 23 and 24 is equal to the width of the upper end of the heat radiating fin 113 when the heat radiating fin 113 is a square column.

The protrusions 21, 22, 23, and 24 may include first to fourth protrusions 21, 22, 23, and 24. The first and second protrusions 21 and 22 may protrude from both sides of the heat dissipation plate 110 in the first axial direction X or the longitudinal direction. The first and second protrusions 21 and 22 may be disposed in a region R3 between the first case coupling portion 118 or the second case coupling portions 119, 24 may be disposed in a region R4 between the first and second case coupling portions 118, The third and fourth protrusions 23 and 24 protrude from both sides in the second axial direction Y or the width direction of the heat dissipation plate 110 and form a region R4 between the cover coupling portions 194 of the cover 190. The number of the third protrusions 23 may be three or more times, for example, four times or more than the number of the first protrusions 21. The number of the third protrusions 23 may be greater than the number of the light emitting devices 173 in each column. The protrusions disposed on two adjacent sides of the side surfaces of the heat dissipation plate 110 may be arranged in different numbers.

At least one or all of the first to fourth protrusions 21, 22, 23, and 24 are arranged such that the period D4 of the adjacent protrusions is narrower than the interval D2 between the lens portions 191, and the heat radiation efficiency may be improved.

As shown in FIG. 20, each of the second guide ribs 12, 13, 14, and 15 is connected to two or more protrusions at the first to fourth protrusions 21, 22, 23, and the heat radiation efficiency may be improved.

Figure 22:
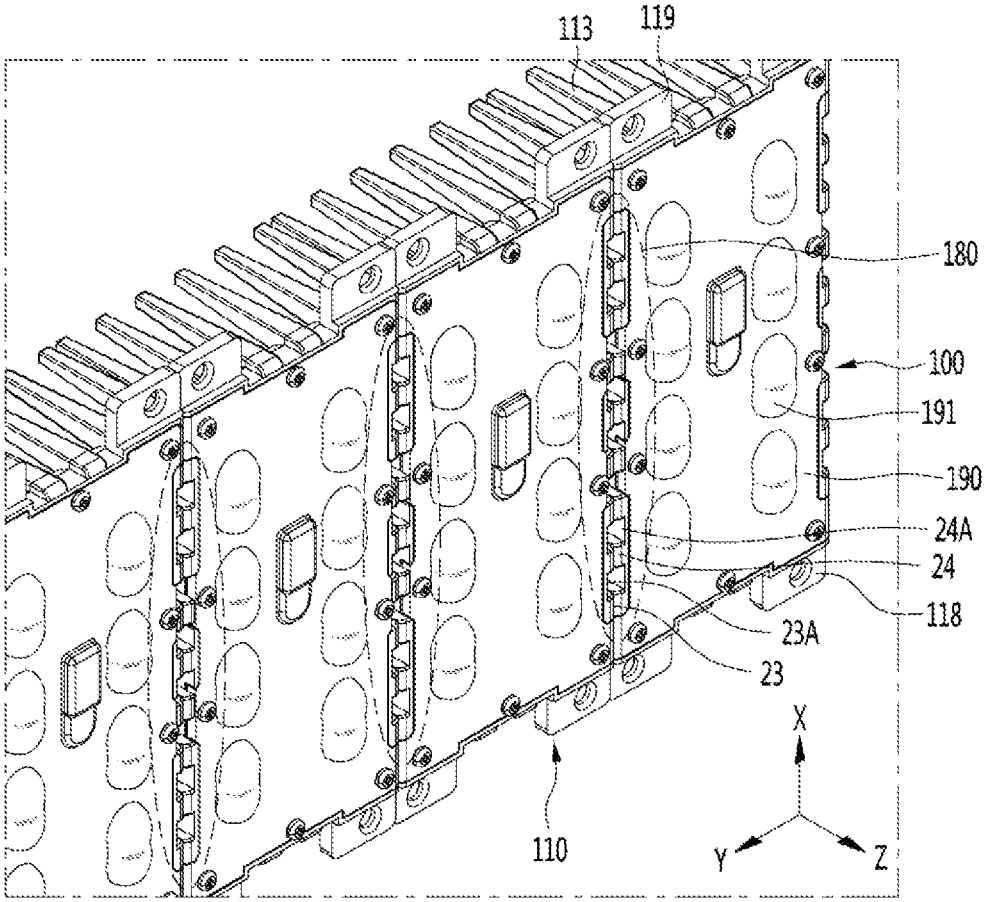
FIG. 22 is a lighting apparatus in which the lighting modules of FIG. 10 are arranged in one line.
Figure 23:
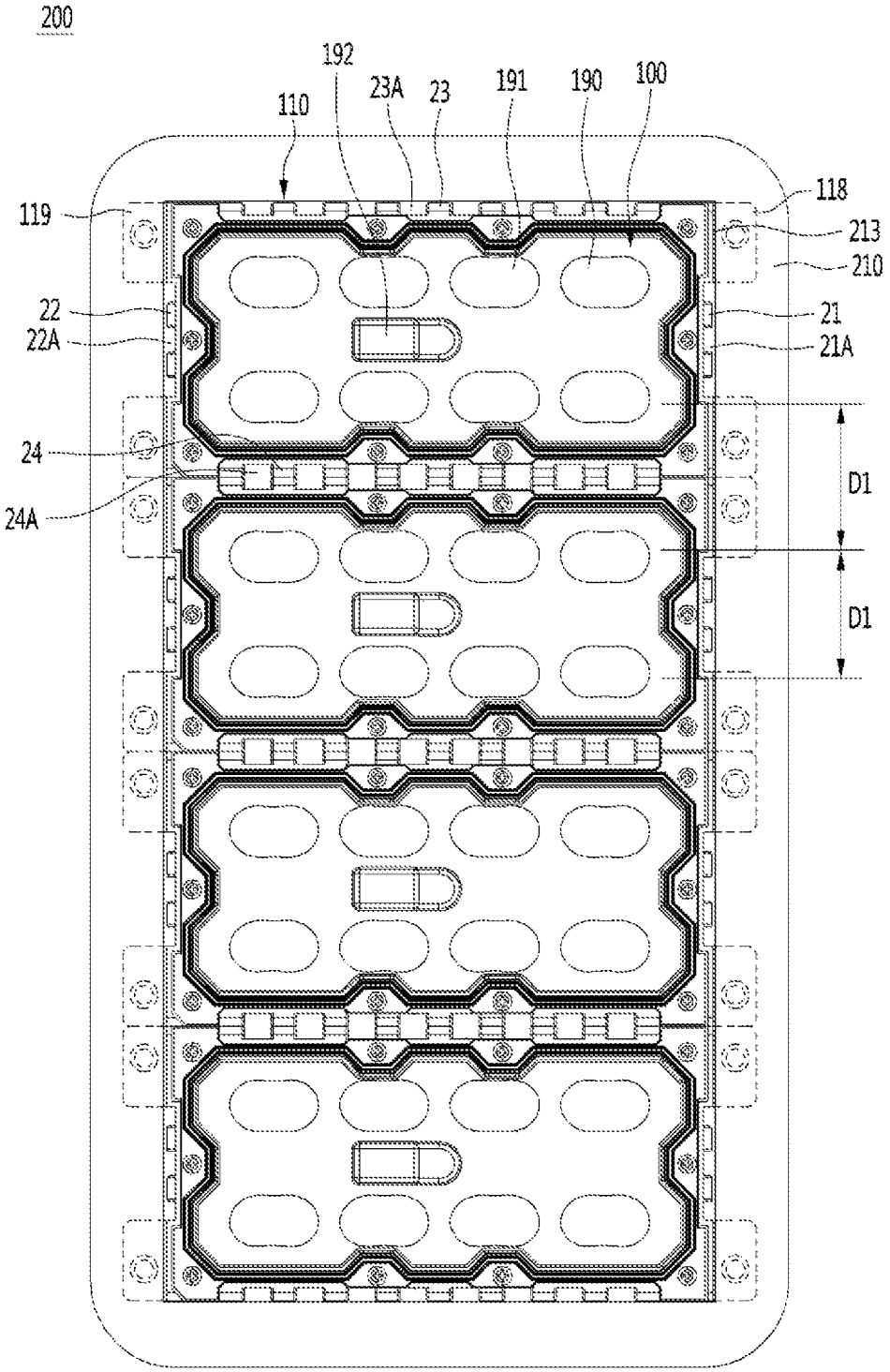
FIG. 23 is an example of a lighting apparatus having a plurality of lighting modules of FIG. 10.
Figure 24:
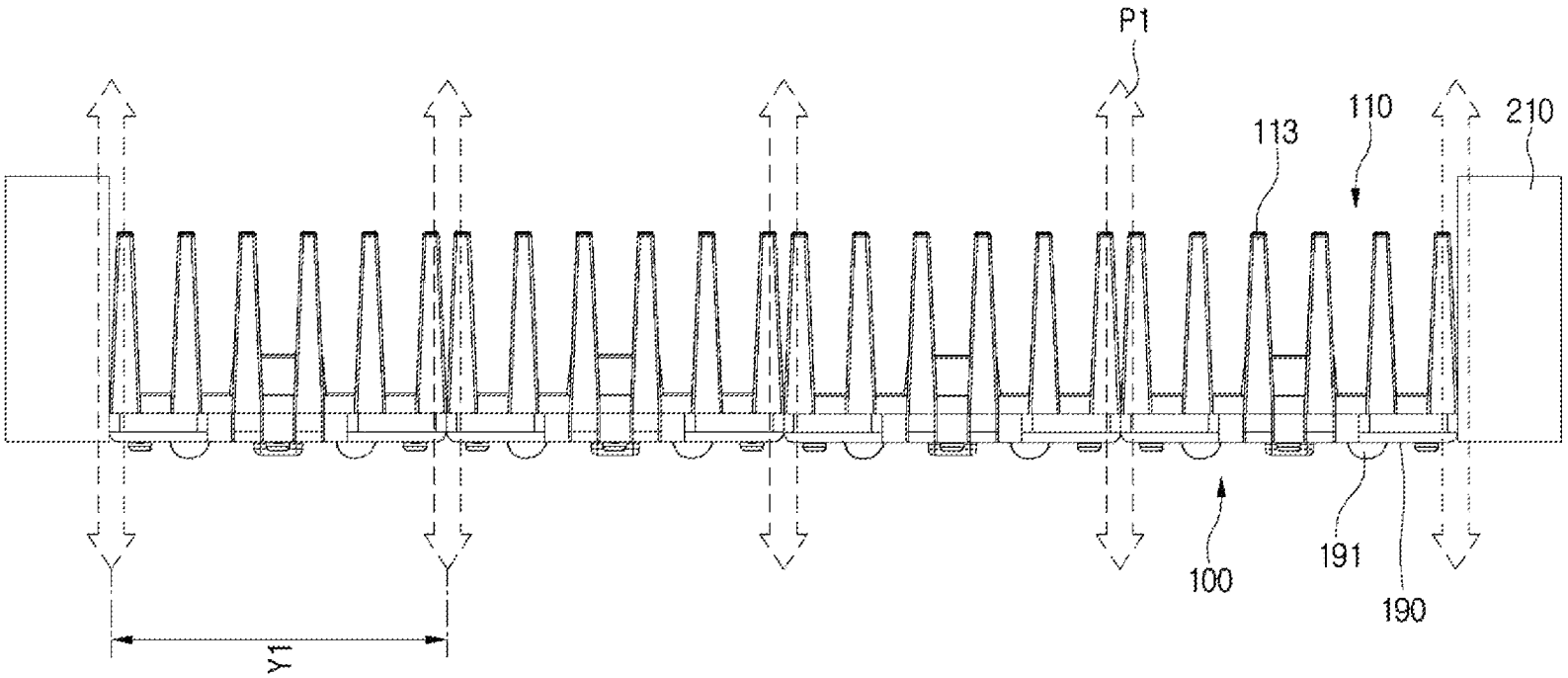
FIG. 24 is a view showing an air flow path of the illumination device of FIG. 23.

As shown in FIGS. 22 to 24, the lighting module 100 may be defined as a unit module. Two or more such unit modules may be arranged. For example, when two or more unit modules are arranged in the width direction Y, they may be brought into contact with each other. When the lighting module 100 is closely arranged in the width direction and is coupled to a part of the case 210 through the first and second case coupling portions 118 and 119, both side surfaces of the lighting modules 100 are in contact with each other. In this case, the protrusions 23, 24 disposed on the sides of the lighting module 100 may be in contact with the protrusions 23, 24 of the other lighting module. When the plurality of lighting modules 100 are arranged, air may flow through the gap portions 21A, 22A, 23A, and 24A disposed on the sides of each lighting module 100. The gap portions 23A and 24A between the protrusions 23 and 24 disposed in the boundary region 180 between the respective lighting modules 100 correspond to each other and are twice as large as the gap portions 23A and 24A, and the air P1 flows as shown in FIG. 19, so that the heat radiation efficiency may be increased. That is, when the lighting module 100 is installed in the width direction, effective heat radiation may be achieved by the gap portions 21A, 22A, 23A, and 24A provided in the boundary region 180 of each lighting module 100. Further, by arranging the lighting modules 100 in close contact with each other, space utilization of the lighting apparatus may be facilitated.

Further, by arranging the plurality of lighting modules 100 in close contact with each other and arranging the interval D1 between the rows of the light emitting devices at equal intervals, the light distribution in the respective light emitting modules 100 and the lighting apparatus having the same is not affected.

In addition, as shown in FIG. 23, the interval D1 between the rows of the light emitting devices or the rows of the lens portions 191 of the cover 190 are arranged identically, so that heat radiated from the light emitting devices may be uniformly dissipated.

The lighting module or the lighting apparatus according to the embodiment may be applied to an indoor or outdoor lighting as an interior lamp, a street lamp, various lamps, an electric signboard, a headlight, and the like.

The features, structures, effects and the like described in the embodiments are included in at least one embodiment of the present invention, and are not necessarily limited to only one embodiment. Furthermore, the features, structures, effects and the like illustrated in the embodiments may be combined and modified by other persons skilled in the art to which the embodiments belong. Therefore, it is to be understood that the present invention is not limited to these embodiments.

Although embodiments have been described with reference to a number of illustrative embodiments thereof, it should be understood that numerous other modifications and embodiments may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

The lighting module according to the embodiment can be used for various illumination devices.

The lighting module according to the embodiment can be used for illumination of indoor or outdoor luminaire.

What is claimed is:

1. A lighting module comprising:

a light emitting module including a printed circuit board and a plurality of light emitting devices on the printed circuit board; and a cover including a cover body disposed on the printed circuit board and a plurality of lens portions disposed on the light emitting device, wherein the plurality of lens portions are disposed such that an interval in a first axial direction is narrower than an interval in a second axial direction, wherein each of the plurality of lens portions includes a concave recess, an incident surface around the recess and an output surface including a curved surface whose surface is convex, wherein at least two light emitting devices arranged in each of the lens portions are disposed in the first axial direction, wherein a bottom of the recess is longer than a length in the second axial direction with respect to a center of the bottom of the recess, wherein the output surface of the lens portion has a length in the first axial direction longer than a length in the second axial direction, wherein the output surface includes a convex curved surface in the first axial direction and includes a concave portion concave in a recess direction at a curved surface in the second axial direction, wherein the bottom of the recess of the lens portion has a length in the first axial direction longer than the length in the second axial direction, and wherein a lower surface of the incident surface of the lens portion has a length in the first axial direction longer than a length in the second axial direction.

2. The heat dissipation of claim 1, further comprising:

a heat radiating plate having a plurality of radiating fins at a lower portion and a recessed region at an upper portion; and a waterproof frame disposed on the heat dissipation plate and outside the printed circuit board, wherein the printed circuit board is disposed in a recess region of the heat dissipation plate, and the waterproof frame is disposed between the heat dissipation plate and the cover.

3. The lighting module of claim 2, wherein the waterproof frame includes a first waterproof protrusion protruding in the cover direction and a second waterproof protrusion protruding in the direction of the heat dissipation plate.

4. The lighting module of claim 3, comprising a heat dissipation pad disposed between the printed circuit board and the heat dissipation plate.

5. The lighting module of claim 2, wherein the heat dissipation plate comprises a first guide rib disposed between the waterproof frame and the printed circuit board, and a second guide rib disposed outside the waterproof frame and the cover.

6. The lighting module of claim 1, wherein two to fourteen of the light emitting devices are disposed in each of the lens portions, and wherein number of the light emitting devices arranged in the first axial direction is larger than a number of the light emitting devices arranged in the second axial direction.

7. The lighting module of claim 6, wherein the light emitting devices disposed in each of the lens portions have a greater number of outer rows than a number of inner rows with respect to the first axial direction passing through a bottom center of the recess.

8. The lighting module of claim 1, wherein an interval between the lens portions disposed in the first axial direction is smaller than a length in the first axial direction of the lens portion.

9. The lighting module of claim 8, wherein the lens portions have the same interval between the first axial directions, and at least one of the lens portions has another interval in the second axial direction.

10. The light-emitting device of claim 1, wherein light incident at a first angle through an edge region of the incident surface of the lens portion is emitted to an edge region of the output surface at a second angle, wherein the first angle is an angle incident with reference to a horizontal axis on a bottom surface of the cover body, wherein the second angle is an angle emitted with respect to a horizontal axis on an upper surface of the cover body, and wherein the second angle is greater than the first angle.

11. The lighting module of claim 10, wherein the lens portions adjacent to each other in the first axial direction are spaced apart from each other at an angle smaller than the second angle with respect to the horizontal axis.

12. The lighting module of claim 1, wherein an interval between the lens portions disposed in the first axial direction is smaller than a height of the lens portion.

13. The lighting module of claim 1, wherein the printed circuit board has a circuit portion for AC driving the light emitting device, and wherein an outer portion of the printed circuit board includes a plurality of recesses in a direction adjacent to the light emitting device.

14. A lighting module comprising:

a heat dissipation plate including a plurality of heat dissipation fins;

a light emitting module including a printed circuit board on the heat dissipation plate and a plurality of light emitting devices on the printed circuit board; and a cover including a cover body disposed on the printed circuit board and plurality of lens portions disposed on the light emitting device, wherein the printed circuit board has a length in a first axial direction longer than a length in a second axial direction, wherein at least two of the light emitting devices are disposed at each lens portion, wherein the lens portion is disposed in M rows in the first axial direction and N columns in the second axial direction, wherein the M is 2 or more, the N is 2 or more and the M is greater than the N, wherein plurality of lens portions are disposed so that an interval in the first axial direction is narrower than an interval in the second axial direction, wherein each of the plurality of lens portions has a concave recess, an incident surface around the recess and an output surface has a curved surface whose a surface is convex, wherein the at least two of the light emitting devices disposed in each of the lens portions are disposed in the first axial direction, wherein a bottom of the recess is longer than a length in the second axial direction with respect to a center of the bottom of the recess, wherein an output surface of the lens portion has a longer length in the first axial direction than a length in the second axial direction, wherein the output surface includes a curved surface convex in the first axial direction and includes a concave portion concave in a recess direction at least one of both sides in the second axial direction, wherein the bottom of the recess of the lens portion has a length in the first axial direction longer than the length in the second axial direction, and wherein a lower surface of the incident surface of the lens portion has a length in the first axial direction longer than a length in the second axial direction.

15. The lighting module of claim 14, wherein the heat radiating plate and the printed circuit board are longer in the first axial direction than in the second axial direction.

16. The lighting module of claim 14, wherein a thickness of the cover body is smaller than a height of the recess and greater than a thickness of the light emitting device.

17. The lighting module of claim 14, wherein the output surface of each lens portion has a symmetrical shape with reference to the second axial direction passing through a bottom center of the recess.

18. The lighting module of claim 14, wherein the concave portion is disposed on at least one side of both sides of the output surface in the second axial direction.

19. The light-emitting device of claim 14, wherein the concave portion is disposed on both sides in the second axial direction of the output surface, which is adjacent to the cover body, and wherein depth of the concave portions disposed on both sides of the output surface are different from each other.

20. The air conditioner of claim 14, further comprising:

a waterproof frame disposed between the heat radiating plate and the cover, and a heat dissipation pad disposed between the printed circuit board and the heat dissipation plate, wherein the printed circuit board is disposed between the heat dissipation pad and the cover, wherein the waterproof frame includes a first waterproof protrusion and a second waterproof protrusion protruding toward the heat dissipating plate, wherein the heat dissipating plate includes a first guide rib disposed between the waterproof frame and the printed circuit board, and a second guide rib disposed outside the waterproof frame and the cover.

* * * * *